US007269368B2

(12) United States Patent
Sato et al.

(10) Patent No.: US 7,269,368 B2
(45) Date of Patent: Sep. 11, 2007

(54) IMAGE FORMING APPARATUS FOR FORMING IMAGE WITH FIXING MEMBER, POWER SUPPLY CONTROL METHOD FOR CONTROLLING THE IMAGE FORMING APPARATUS, AND POWER SUPPLY CONTROL PROGRAM FOR CONTROLLING THE IMAGE FORMING APPARATUS

(75) Inventors: Naoki Sato, Kanagawa (JP); Hiroto Ohishi, Kanagawa (JP); Masahide Nakaya, Kanagawa (JP); Keiichi Sugai, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 160 days.

(21) Appl. No.: 11/045,268

(22) Filed: Jan. 31, 2005

(65) Prior Publication Data

US 2005/0220474 A1 Oct. 6, 2005

(30) Foreign Application Priority Data

Feb. 2, 2004 (JP) ..... 2004-025512
Dec. 17, 2004 (JP) ..... 2004-366133

(51) Int. Cl.
*G03G 15/20* (2006.01)

(52) U.S. Cl. ..... 399/69

(58) Field of Classification Search ..... 399/69, 399/70

See application file for complete search history.

(56) References Cited

U.S. PATENT DOCUMENTS

2004/0247334 A1* 12/2004 Kishi et al. ..... 399/69

FOREIGN PATENT DOCUMENTS

| | | | |
|---|---|---|---|
| JP | 60087378 A | * | 5/1985 |
| JP | 10091036 A | * | 4/1998 |
| JP | 2000-315567 | | 11/2000 |
| JP | 2001356622 A | * | 12/2001 |
| JP | 2002-357966 | | 12/2002 |
| JP | 2003-140484 | | 5/2003 |

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus for forming an image with a fixing member, which fixing member includes a first heating member and a plurality of second heating members is disclosed. The image forming apparatus includes a capacitor, a charging part for charging the capacitor, a first drive part for lighting on/off the first heating member by controlling a first power supply to the first heating member, a second drive part for lighting on/off at least one of the plurality of second heating members by controlling a second power supply to the plurality of second heating members, and a control part for dividing the plurality of second heating members into groups and permitting at least one of the groups to receive the second power supply during a waiting period of the image forming apparatus.

17 Claims, 14 Drawing Sheets

IMAGE FORMING APPARATUS FOR FORMING IMAGE WITH FIXING MEMBER, POWER SUPPLY CONTROL METHOD FOR CONTROLLING THE IMAGE FORMING APPARATUS, AND POWER SUPPLY CONTROL PROGRAM FOR CONTROLLING THE IMAGE FORMING APPARATUS

BACKGROUND OF THE INVENTION

1. Field of the Invention

The present invention relates to an image forming apparatus, a power supply control method, and a power supply control program, and more particularly to an image forming apparatus including a fixing apparatus provided with a heating member, such as a fixing heater that heats with charging power of a capacitor, an power supply control method and a power supply control program which use the image forming apparatus.

2. Description of the Related Art

A heating member (fixing heater) in a fixing apparatus used for an image forming apparatus, such as an electrophotographic type image forming apparatus preferably requires a rapid supply of electric power. In addition to a power supply from a commercial power source, a chargeable subsidiary power source using an electric double layer condenser, for example, is applied to a heating member of a fixing apparatus used for an electrophotographic type image forming apparatus, as disclosed in Japanese Laid-Open Patent Application Nos. 2000-315567, 2002-357966, and 2003-140484, for providing a technology enabling rapid build up and enhancing energy conservation ability.

With the technology disclosed in the above-described documents, deterioration of fixation property caused by lack of electric power can be prevented since the technology uses a large size capacitor as an subsidiary power source for enabling instantaneous supply of large current to a fixing apparatus in a case where the power supply from a commercial power source to the fixing apparatus is short. The foregoing technology, however, requires the capacitor to be charged at certain timing after the power is supplied to the heating member by the discharge of the capacitor.

That is, with this type of image forming apparatus, the capacitor is to be charged by supplying power from the commercial power source to a charging circuit during a waiting time which is a time other than an image forming operation (includes, for example, standby mode, energy save mode). Meanwhile, even during the waiting time, the temperature of a fixing roller is to be maintained at a substantially uniform temperature by the heating member, such as an AC halogen heater which heats by receiving power supply from the commercial power source.

For example, in a case where plural AC halogen heaters are employed in correspondence with, for example, the sizes of paper, the AC halogen heaters inside a fixing roller may be configured in a manner shown in FIG. 15. FIG. 15 is a drawing showing an exemplary configuration of AC halogen heaters provided in the fixing roller. In a case of forming an image on an A4 size paper, only an AC halogen heater 1000, being disposed at the center of FIG. 15, is used. In a case of forming an image on a wide size paper, such as A3 size paper, the AC halogen heater 1000 in the center and AC halogen heaters 1001 and 1002 disposed on both sides thereof are used simultaneously.

Furthermore, in a case where the power of the AC halogen heater 1000 is 600 W (=P1), the power of the AC halogen heaters 1001 and 1002 are 700 W (=P2), the power for charging the capacitor is set to, for example, 500 W (=P3) so as to satisfy a relation of "P1, P2>P3".

In a case of lighting the AC halogen heaters 1000, 1001, and 1002 at the same time of charging the capacitor due to the fall of temperature of the fixing roller during a waiting time, the power for charging the capacitor would exceed a power being no less than a rated power (for example, in Japan, the rated power of a typical plug socket is no less than 15 A/1500 W). Accordingly, a charging circuit, serving to charge the capacitor, is designed for restraining the charging power to a power no more than the rated power in a case where the power P1 of the AC halogen heater 1000 and the power P3 for charging the capacitor are simultaneously used, or a case where the power P2 of the AC halogen heaters 1001 and 1002 are used and the power P3 for charging the capacitor are simultaneously used.

Furthermore, in the above-described conventional example, the temperature of the AC halogen heater 1000 is optimally controlled in accordance with the detection value obtained from a thermistor 1010, and the temperatures of the AC halogen heaters 1001 and 1002 are optimally controlled in accordance with the detection values obtained from thermistors 1011 and 1012.

Nevertheless, in a case of separately controlling the temperature of the AC halogen heater 1000 and the temperatures of the AC halogen heaters 1001 and 1002, there is a possibility that the AC halogen heaters 1000, 1001, and 1002 are lighted at the same time, thereby leading to a risk of charging the capacitor to a power same as or greater than the rated power. When the power is same as or greater than the rated power, the image forming apparatus is unable to use the commercial power source.

It is to be noted that the length of charging time would extend if the power to the capacitor is restrained to a power which is same as or less than the rated power. Therefore, in a case where a user commands an image forming operation in the midst of charging the capacitor, image forming performance may deteriorate due to lack of charge of the capacitor.

SUMMARY OF THE INVENTION

It is a general object of the present invention to provide an image forming apparatus, a power supply control method, and a power supply control program that substantially obviate one or more of the problems caused by the limitations and/or disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an image forming apparatus, a power supply control method, and a power supply control program particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides an image forming apparatus for forming an image with a fixing member, which fixing member includes a first heating member and a plurality of second heating members, the image forming apparatus including a capacitor, a charging part for charging the capacitor, a first drive part for lighting on/off the first heating member by controlling a first power supply to the first heating member, a second drive part for lighting on/off at least one of the plurality of second heating members by controlling a second power supply to the plurality of second heating members, and a control part for dividing the plurality of second heating members into groups and permitting at least one of the groups to receive the second power supply during a waiting period of the image forming apparatus.

Furthermore, the present invention provides a power supply control method for controlling an image forming apparatus for forming an image with a fixing member, which fixing member includes a first heating member for receiving power supply from a capacitor and a plurality of second heating members, the power supply control method comprising the steps of a) dividing the plurality of second heating members into groups, b) permitting at least one of the groups to receive a power supply during a waiting period of the image forming apparatus, c) controlling the power supply to the plurality of second heating members for lighting on the group permitted to receive the power supply, and d) charging the capacitor.

Furthermore, the present invention provides a power supply control program for controlling an image forming apparatus for forming an image with a fixing member, which fixing member includes a first heating member for receiving power supply from a capacitor and a plurality of second heating members, the program including a dividing function for dividing the plurality of second heating members into groups, a permitting function for permitting at least one of the groups to receive a power supply during a waiting period of the image forming apparatus, a controlling function for controlling the power supply to the plurality of second heating members for lighting on the group permitted to receive the power supply, and a charging function for charging the capacitor.

Other objects and further features of the present invention will be apparent from the following detailed description when read in conjunction with the accompanying drawings.

DESCRIPTION OF THE PREFERRED EMBODIMENTS

In the following, embodiments of the present invention are described in detail with reference to the accompanying drawings.

First Embodiment

Figure 1:
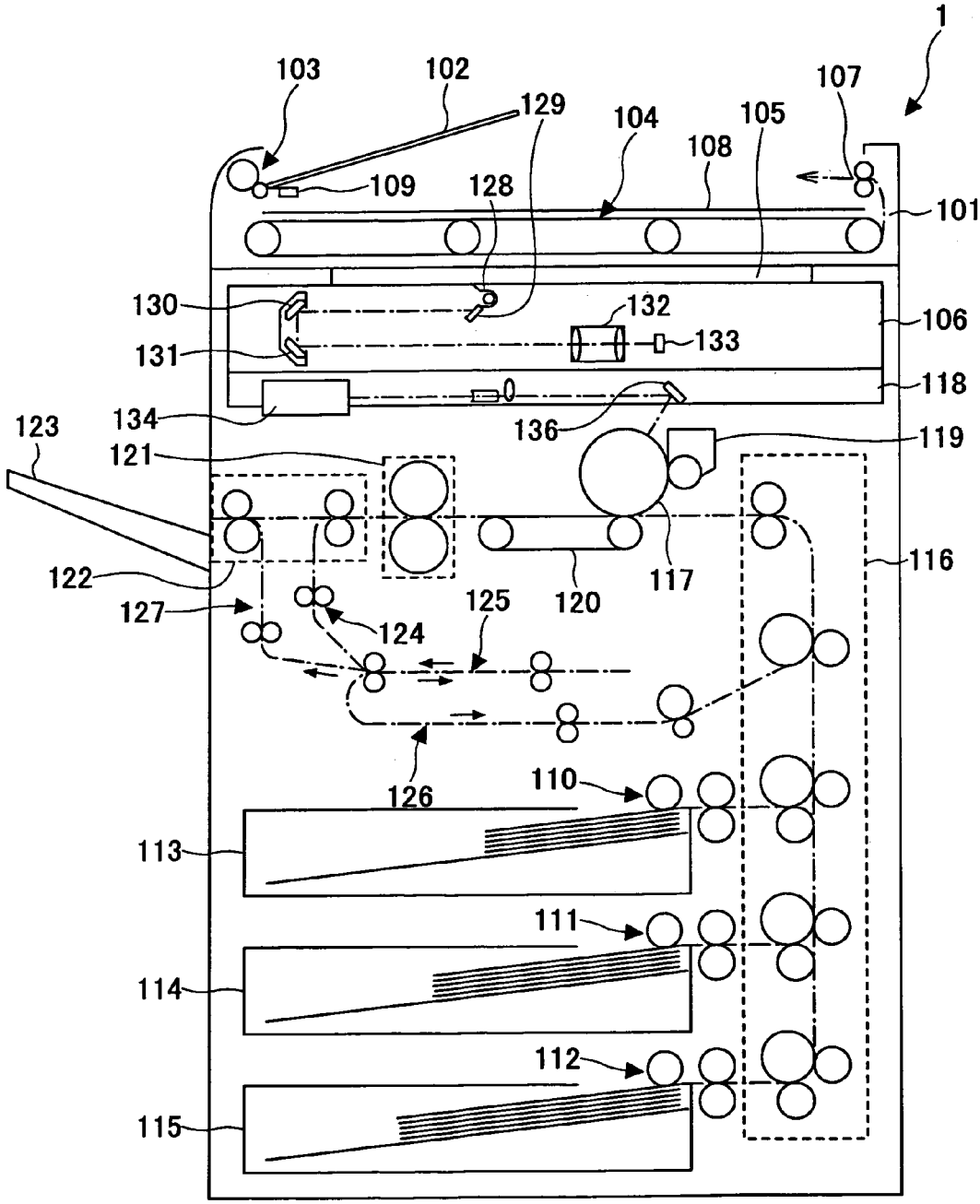
FIG. 1 is a vertical sectional front view of a digital copying apparatus according to a first embodiment of the present invention.

FIG. 1 is a vertical sectional front view of a digital copying apparatus 1 according to a first embodiment of the present invention. The digital copying apparatus 1, serving as an image forming apparatus of the present invention, is an example of the so-called multiple function processing machine. The digital copying apparatus 1 includes a copy function and other functions (e.g. printer function, facsimile function), in which functions such as the copy function, the printer function or the facsimile function can be sequentially switched and selected by operating an application switching key in an operation part (not shown). Accordingly, the digital copying apparatus 1 can be switched to a copy mode when the copy function is selected, a printer mode when the printer function is selected, and a facsimile mode when the facsimile function is selected.

Next, a configuration of the digital copying apparatus 1 and an operation during the copy mode are described.

In FIG. 1, an original, having its image side facing upward, is placed on an original tray 102 of an automatic document feeding apparatus (hereinafter referred to as "ADF") 101. When a start key of the operation part (not shown) is depressed, the original is fed to a predetermined position on a contact glass 105 by a feeding roller 103 and a conveyor belt 104. The ADF 101 has a counting function for counting the number of originals whenever the feeding of a single original is completed. After the original disposed on the contact glass 105 has its image information read by an image reading apparatus 106, the original is discharged onto a discharge tray 108 by the conveyor belt 104 and a discharge roller 107.

When an original set detector 109 detects the next original placed on the original tray 102, a bottom most original situated on the original tray 102 is, in a likewise manner, fed to a predetermined position on the contact glass 105 by the feeding roller 103 and the conveyor belt 104. Likewise, after the original disposed on the contact glass 105 has its image information read by the image reading apparatus 106, the original is discharged onto the discharge tray 108 by the conveyor belt 104 and the discharge roller 107. The feeding roller 103, the conveyor belt 104, and the discharge roller 107 are driven by a conveyance motor.

A first feeding apparatus 110, a second feeding apparatus 111, and a third feeding apparatus 112, whenever selected, serve to feed transfer paper stacked thereon. A vertical conveying unit 116 conveys the transfer paper to a position contacting a photoconductor 117. The photoconductor 117 employs, for example, a photoconductor drum, and is rotatably driven by a main motor (not shown).

The image data (image information), which is read from the original by the image reading apparatus 106, is subject to a predetermined image process by an image processing apparatus (not shown). Then, the image data is converted to optical information by a writing unit 118. The photoconductor 117, after being uniformly charged by an electrifying member (not shown), is exposed with optical information from the writing unit 118 for forming an electrostatic latent image thereon. The electrostatic latent image formed on the photoconductor 117 is developed by a developing apparatus 119, to thereby form a toner image.

It is to be noted that the writing unit 118, the photoconductor 117, the developing apparatus 119, and peripheral apparatuses disposed around the photoconductor 117 are provided to form a printer engine for forming an image onto a medium (e.g. paper) by employing an electrophotographic method.

The conveyor belt 120 serves as a sheet-conveying part and also as a transfer part. The conveyor belt 120, being applied with transfer bias from a power source, conveys the transfer sheet from the vertical conveying unit 116 at the same rate as the photoconductor 117, and transfers the toner image on the photoconductor 117 to the transfer sheet. The transfer sheet has the toner image fixed thereto by a fixing apparatus 121 and is discharged from a discharge tray 123 by a discharge unit 122. After the toner image on the photoconductor 117 is transferred, residual toner remaining on the photoconductor 117 is cleaned off by a cleaning apparatus (not shown).

The above-described operation is an operation executed in a normal mode in which an image is copied onto one side of a sheet of paper. In a double-side-mode for copying an image(s) onto both sides of a transfer sheet, a transfer sheet, being fed from one of the feeding trays 113-115 and having an image formed on a front side thereof, is directed to a double-side conveying path 124 rather than to the discharge tray 123. Then, a reversing unit 125 switches back the transfer sheet, to thereby reverse the front side and back side of the transfer sheet. Then, the transfer sheet is conveyed to a double-side conveying unit 126.

Then, the transfer sheet, being conveyed to the double-side conveying unit 126, is conveyed to the vertical conveying unit 116 by the double-side conveying unit 126. The vertical conveying unit 116 conveys the transfer sheet to a position contacting the photoconductor 117. Then, a toner formed on the photoconductor 117 is transferred onto the back side of the transfer sheet in a similar manner described above. Finally, a double-sided copy is obtained by fixing the toner image onto the transfer sheet with the fixing apparatus 121. The double-sided copy is discharged to the discharge tray 123 by the discharge unit 122.

In a case of discharging the transfer sheet in a reversed state, the transfer sheet, having its front and back side reversed by the switchback of the reversing unit 125, is discharged to the discharge tray 123 via a reverse discharge conveying path 127 rather than being conveyed to the double-side conveying unit 126.

In a case of the printer mode, image data from the outside rather than the image data from the image processing apparatus are input to the writing unit 118. Then, the operation of forming an image onto a transfer sheet is executed in a same manner described above. In a case of the facsimile mode, the image data read by the image reading apparatus 106 is sent to an opponent from a facsimile transmission part (not shown). Furthermore, image data received from the opponent by the facsimile transmission part rather than the image data from the image processing part are input to the writing unit 118. Then, the operation of forming an image onto a transfer sheet is executed in a same manner described above.

The digital copying apparatus 1 further includes a mass paper supply apparatus (LCT) (not shown), a finisher including, for example, a sorter, a hole-puncher, and a stapler, an operation part for executing, for example, setting of document reading modes and/or a copy scale ratio, setting of finish processes with the finisher, and/or indication to the operator.

Figure 2:
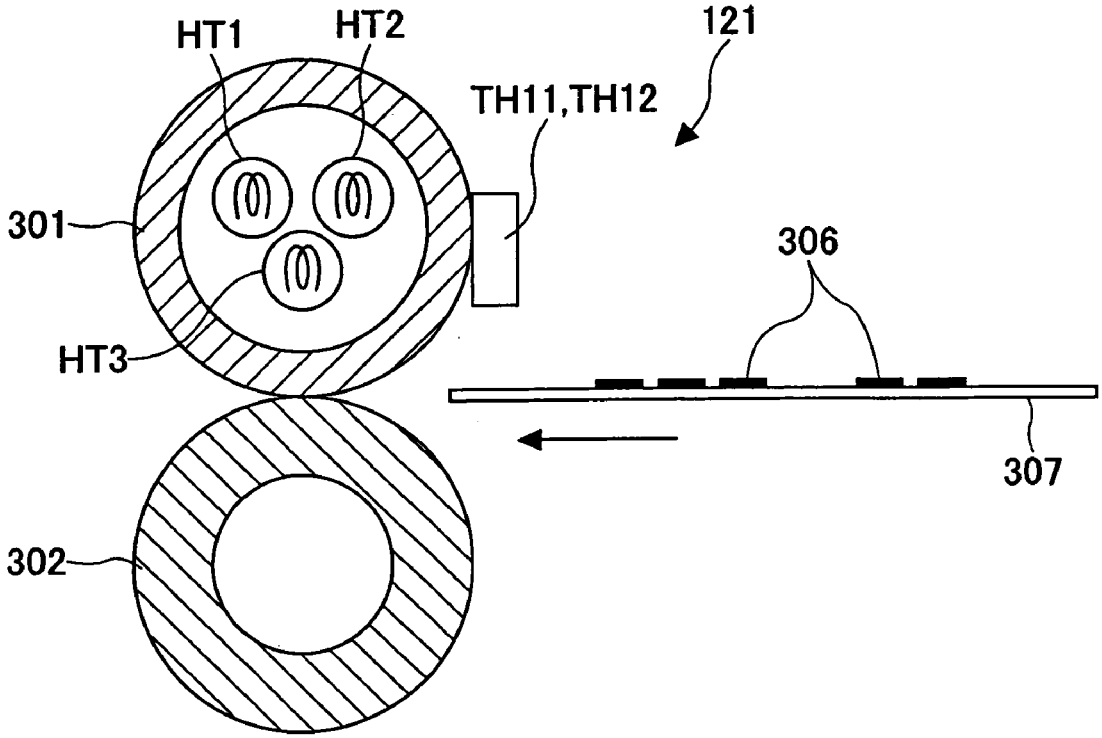
FIG. 2 is a drawing showing an exemplary configuration of a fixing apparatus.

Next, a configuration of the fixing apparatus 121 is described with reference to FIG. 2. In the fixing apparatus 121 shown in FIG. 2, a pressure roller 302, serving as a pressure member formed of an elastic material (e.g. silicone rubber), is abutted with a predetermined pressing force against a fixing roller 301, serving as a fixing member, by a pressure part (not shown). Although the fixing member and the pressure member are typically provided in a roller form, both or either one of the members may be provided in an endless belt form. The fixing apparatus 121 includes AC fixing heaters HT1 (first heating member), HT2, and HT3 (second heating members) which are suitably disposed at prescribed positions. For example, the AC fixing heaters HT1, HT2, and HT3 are disposed inside the fixing roller 301 for heating the fixing roller (i.e. fixing member) 301 from the inside.

The fixing roller 301 and the pressure roller 302 are rotatably driven by a driving mechanism (not shown). Temperature sensors (e.g. thermistors) TH11 and TH12 abut the surface of the fixing roller 301 and detect the surface temperature (fixing temperature) of the fixing roller 301. A sheet 307 (e.g. transfer paper), serving as a medium carrying a toner 306 thereon, is passed through a nipping portion between the fixing roller 301 and the pressure roller 302, to thereby have a toner image fixed thereto by the heat and pressure applied from the fixing roller 301 and the pressure roller 302.

Plural AC fixing heaters HT2 and HT3 (second heating members) are switched on when the temperature of the fixing roller 301 has not reach a target temperature for serving as a main heater for mainly heating the fixing roller 301. In a more specific example, the AC fixing heaters HT2 and HT3 in the fixing roller 301 are disposed in a manner unequally dividing a main scanning direction area into two parts depending on the size of the transfer area (e.g. B5 size or A4 size). That is, the AC fixing heaters HT2 and HT3 are allocated for heating predetermined areas, in which the AC fixing heater HT2 covers a B5 size area with respect to a reference position, and the AC fixing heater HT3 covers the remaining area (A4 size-B5 size) with respect to the reference position.

The AC heater HT1 (first heating member) is a subsidiary heater for subsidiarily heating the fixing roller 301. The AC heater HT1 is switched on upon a warm-up time of the fixing apparatus 121 (e.g. during the actuation of the main power source of the digital copying apparatus 1, or during a buildup time upon shifting from an energy saving off-mode to a copy-ready state) or a time when the temperature of the fixing roller 301 has not reached a target temperature during an image forming operation.

Figure 3:
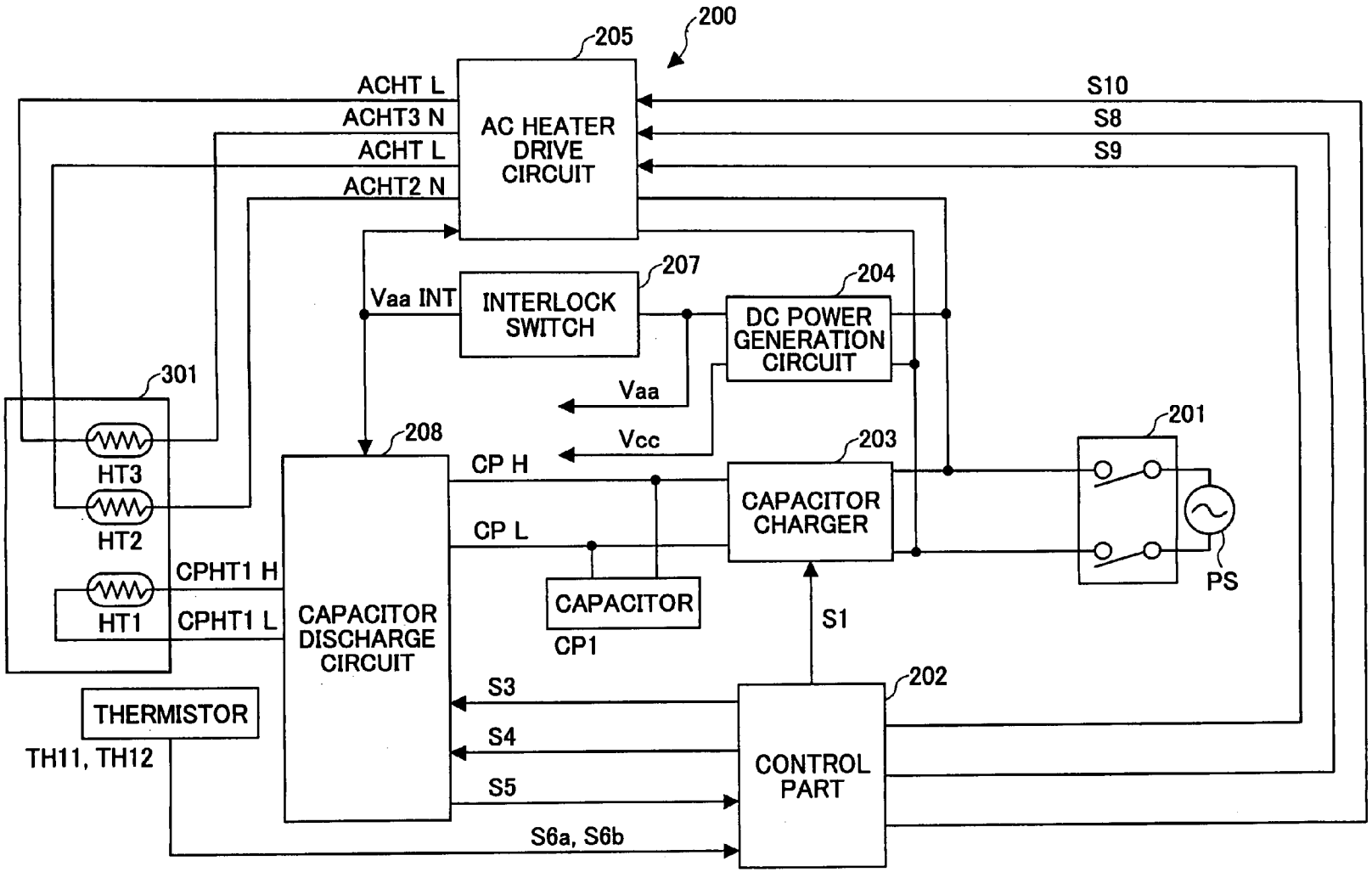
FIG. 3 is a circuit diagram showing a power source control system of a digital copying apparatus including a fixing apparatus.

FIG. 3 is a circuit diagram showing an exemplary configuration of a power source control system (power source circuit 200) of the digital copying apparatus 1 including the fixing apparatus 121. The power source control system shown in FIG. 3 includes a main power source switch (SW)

201 for switching on/off the supply of an AC power source (commercial alternating current supply) PS, a control part 202 for mainly controlling respective parts of the power source circuit 200, a capacitor CP1 which is the subsidiary power source of the AC fixing heater HT1, a capacitor charger 203 serving as a charging circuit for charging the capacitor CP1, a DC power source generation circuit 204 for generating a DC power source of the digital copying apparatus 1, an AC heater drive circuit 205 serving as a second drive circuit for supplying AC voltage to the AC fixing heaters HT2 and HT3, an interlock switch 207, and a capacitor discharge circuit 208 serving as a first drive circuit for discharging the capacitor CP1 and supplying DC voltage to the AC fixing heater HT1.

The AC power source PS supplies AC voltage to the AC heater drive circuit 205, the DC power source generation circuit 204, and the capacitor charger 203 via the main power source 201 and an input current detection circuit 206.

The control part 202 mainly serves to control the respective parts of the power source circuit 200. The control part 202 controls operation of the capacitor charger 203, the AC heater drive circuit 205, and the capacitor discharge circuit 208. More specifically, the control part 202 transmits a control signal S1 to the capacitor charger 203 for controlling a charging operation of the capacitor charger 203 with respect to the capacitor CP1. Furthermore, the control part 202 transits control signals S3 and S4 to the capacitor discharge circuit 208 for controlling an on/off operation of the capacitor discharge circuit 208 with respect to the AC fixing heater HT1. Furthermore, the control part 202 transmits control signals S8, S9, and S10 to the AC heater drive circuit 205 for controlling an on/off operation of the AC heater drive circuit 205 with respect to the AC fixing heaters HT2 and HT3.

The DC power source generation circuit 204 generates a power source Vcc, which is used mainly for a control system inside the image forming apparatus, and a power source Vaa, which is used mainly for a drive system and/or a medium voltage power source, in accordance with the AC voltage input via the main power source 201, and outputs the generated power to respective parts.

The interlock switch 207 is an on/off switch which interlocks with a cover part (not shown) of the digital copying apparatus 1. In a case where a drive part and/or a medium voltage application part are provided in a touchable state when the cover part is opened, the interlock switch 207 cuts-off the power source for stopping the operation of the drive part or the application of power to the medium voltage application part when the cover part is opened. A portion of the power source Vaa, being generated by the DC power source generation circuit 204, is input to the interlock switch 207 and is output to the capacitor discharge circuit 208 and the AC heater drive circuit 205.

The AC heater drive circuit 205 switches on/off the AC fixing heaters HT2 and HT3 according to the control signals S8, S9, and S10 from transmitted from the control part 202. The capacitor charger 203, being connected to the capacitor CP1, charges the capacitor CP1 according to the control signal S1 transmitted from the control part 202. The capacitor CP1 includes a large size capacitor such as a condenser having an electric double layer. The capacitor CP1, being connected to the capacitor charger 203 and the capacitor discharge circuit 208, is charged by the capacitor charger 203. The power charged to the capacitor CP1 is supplied to the AC fixing heater HT1 according to the on/off control of the capacitor discharge circuit 208.

The capacitor discharge circuit 208, in accordance with the control signals S3, S4 transmitted from the control part 202, supplies the power stored in the capacitor CP1 to the AC fixing heater HT1, to thereby switch on/off the AC fixing heater HT1. The temperature sensors TH11 and TH12, being disposed in the proximity of the fixing roller 301, transmit detection signals S6*a* and S6*b* in accordance with the surface temperature of the fixing roller 301. The resistance values of the temperature sensors TH11 and TH12 change according to temperature. The control part 202 detects the surface temperature of the fixing roller 301 by referring to the detection signals S6*a*, S6*b* generated according to the resistance values of the temperature sensors TH11 and TH12 which change according to temperature. Here, the temperature sensor TH11 may be disposed in correspondence with, for example, the heating area of the AC fixing heater HT2, and the temperature sensor TH12 may be disposed in correspondence with, for example, the heating area of the AC fixing heater HT3.

Figure 4:
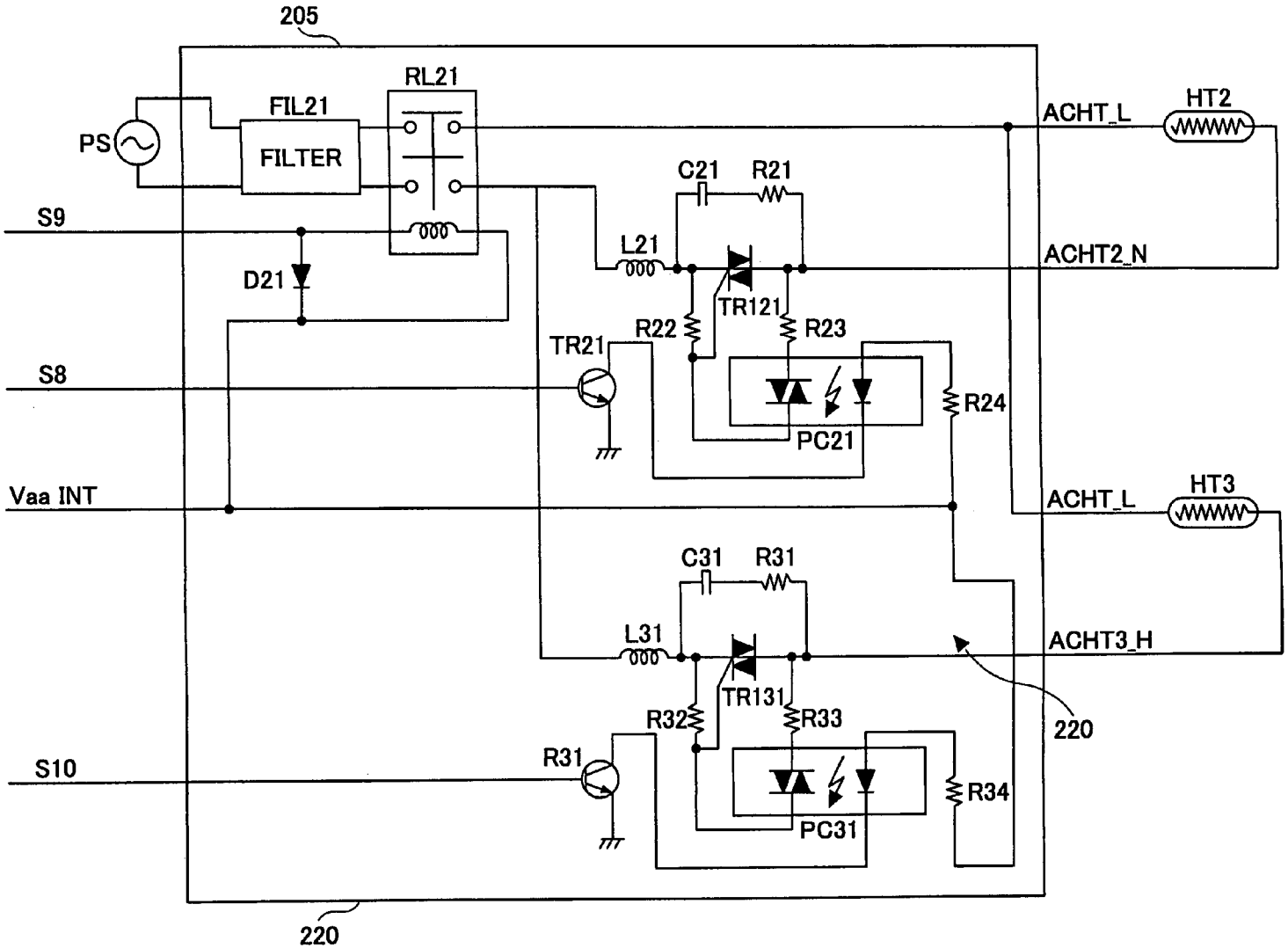
FIG. 4 is a circuit diagram showing an exemplary configuration of an AC heater drive circuit.

FIG. 4 is a circuit diagram showing an exemplary configuration of the AC heater drive circuit 205 of FIG. 3. The AC heater drive circuit 205 includes a filter FIL21 for removing noise of the input AC power source, a protective fixing relay RL21 which is switched on/off according to the control signal S9 transmitted from the control part 202, a diode D21 serving as a counter-electromotive force prevention diode with respect to the protective fixing relay RL21, and a heater on/off circuit 220 for switching on/off the AC fixing heaters HT2 and HT3.

The AC power source PS is connected to one end of the respective AC fixing heaters HT2 and HT3 via the filter FIL21 and the protective fixing relay RL21. The heater on/off circuit 220 is connected to the other end of the respective AC fixing heaters HT2 and HT3.

A portion of the heater on/off circuit 220 corresponding to, for example, the AC fixing heater HT2 includes a triac TRI21 for switching on/off the AC power source PS, a photocoupler PC21 for switching on a base of the triac TRI21 and insulating a signal from the control part 202 situated downstream thereof, a transistor TR21 for driving a light emitting side LED of the photocoupler PC21, a noise absorption snubber circuit including a condenser C21 and a resistance R21, a noise absorption inductor L21, a resistance R22 which is a follow current prevention resistance, and resistances R23, R24 which are current restraining resistances for the photocoupler PC21.

Likewise, the portion corresponding to the AC fixing heater HT3 includes a triac TRI31 for switching on/off the AC power source PS, a photocoupler PC31 for switching on a gate of the triac TRI31 and insulating a signal from the control part 202 situated downstream thereof, a transistor TR31 for driving a light emitting side LED of the photocoupler PC31, a noise absorption snubber circuit including a condenser C31 and a resistance R31, a noise absorption inductor L31, a resistance R32 which is a follow current prevention resistance, and resistances R33, R34 which are current restraining resistances for the photocoupler PC31.

In the AC heater drive circuit 205, the AC fixing heater HT2 is lit on by supplying power thereto in a state where the protective fixing relay RL21 and the base of the transistor TR21 are both switched on. Likewise, the AC fixing heater HT3 is lit on by supplying power thereto in a state where the protective fixing relay RL21 and the base of the transistor TR31 are both switched on.

The control part 202 controls the lighting on/off of the AC fixing heater HT2 by switching on/off the control signal S8 transmitted to the base of the transistor TR21 of the heater on/off circuit 220 in a state where the control signal S9 transmitted to the protective fixing relay RL21 is switched on. Likewise, the control part 202 controls the lighting on/off of the AC fixing heater HT3 by switching on/off the control signal S10 transmitted to the base of the transistor TR31 of the heater on/off circuit 220 in a state where the control signal S9 transmitted to the protective fixing relay RL21 is switched on.

Figure 5:
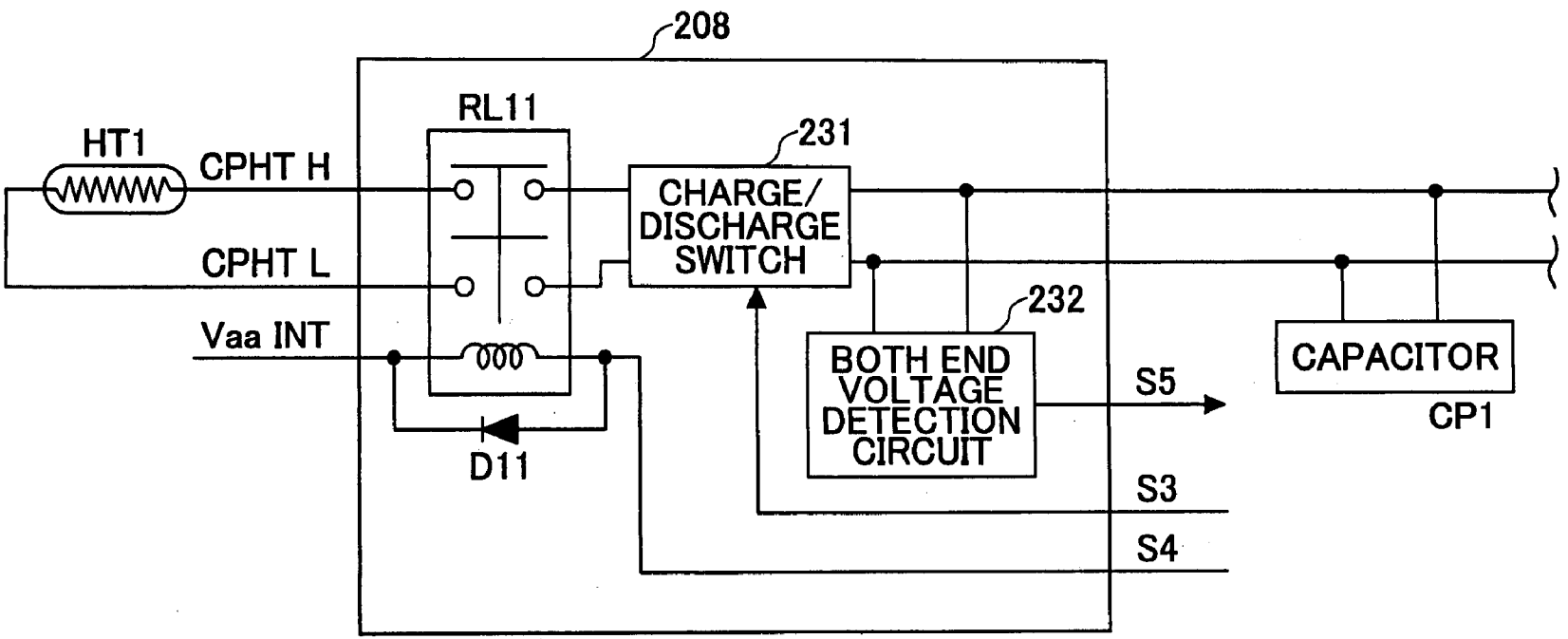
FIG. 5 is a circuit diagram showing an exemplary configuration of a capacitor discharge circuit.

FIG. 5 is a circuit diagram showing an exemplary configuration of the capacitor discharge circuit 208 of FIG. 3. As shown in FIG. 5, the capacitor discharge circuit 208 includes a charge/discharge switch 231, a protective fixing relay RL11, a diode D11 serving as a counter-electromotive force prevention diode with respect to the protective fixing relay RL11, and a both end voltage detection circuit 232 for detecting both end voltage of the capacitor CP1.

The charge/discharge switch 231 and the protective fixing relay RL11 are connected to both ends of the capacitor CP1. The charge/discharge switch 231 is switched on/off by a control signal S3 transmitted from the control part 202. Likewise, the protective fixing relay RL11 is switched on/off by a control signal S4 transmitted from the control part 202. When both the charge/discharge switch 231 and the protective fixing relay RL11 are switched on, the charge stored in the capacitor CP1 is discharged, to thereby supply voltage to the AC fixing heater HT1.

The both end voltage detection circuit 232 detects voltage of both ends of the capacitor CP1 and outputs a voltage signal S5 of the detected voltage to the control part 202. The control part 202 monitors the charge state of the capacitor CP1 by continuously monitoring the voltage signal S5.

Figure 6:
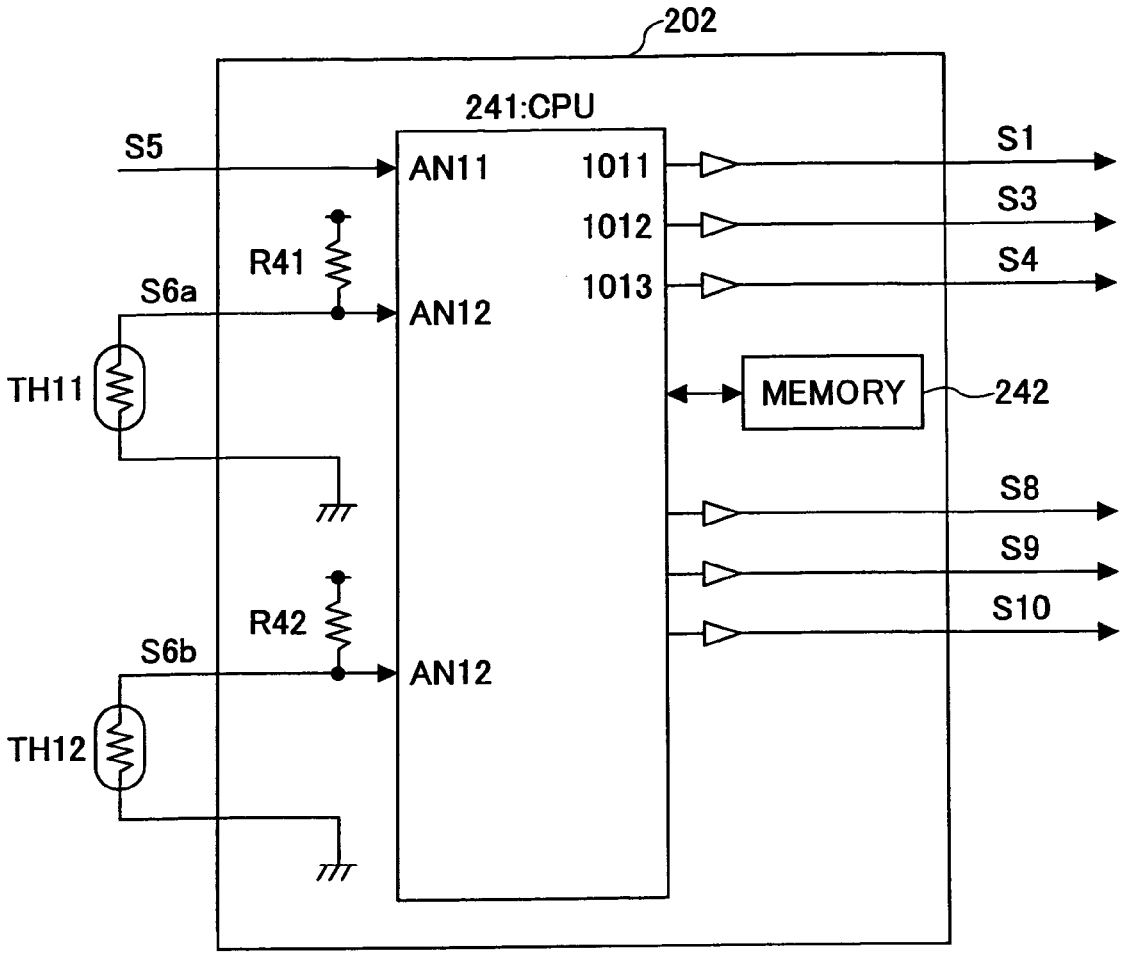
FIG. 6 is a circuit diagram showing an exemplary configuration of a control part.

FIG. 6 is a circuit diagram showing an exemplary configuration of the control part 202 of FIG. 3. As shown in FIG. 6, the control part 202 includes, for example, a CPU 241 and a memory 242. The CPU 241 is connected to the memory 242 which stores a program and/or data for controlling the digital copying apparatus 1. The CPU 241 controls, for example, the printer engine and the power source circuit 200 in accordance with the program stored in the memory 242.

Input to the CPU 241 are the voltage signal (analog signal) S5 for indicating the both end voltages of the capacitor CP1 detected by the both end voltage detection circuit 232 in the capacitor discharge circuit 208, the detection signal (analog signal) S6*a* having its voltage divided by the temperature sensor TH11 for detecting the surface temperature of the area corresponding to the AC fixing heater HT2 in the fixing roller 301 and by the resistance value of the resistance R41, and the detection signal (analog signal) S6*b* having its voltage divided by the temperature sensor TH12 for detecting the surface temperature of the area corresponding to the AC fixing heater HT3 in the fixing roller 301 and by the resistance value of the resistance R42.

The CPU 241 outputs, for example, the control signal S1 for switching on/off the charge of the capacitor CP1, the control signal S3 for switching on/off the charge/discharge switch 231, the control signal S4 for switching on/off the protective fixing relay RL11, the control signals S8, S10 for switching on/off the heater on/off circuit 220, and the control signal S9 for switching on/off the protective fixing relay RL21 via an IO port (see also FIG. 3).

Thus structured, the first embodiment of the present invention serves to control the consumption of power supplied from the AC power source PS during a waiting time (including standby time, power-save mode time). With reference to FIG. 3, the units which consume AC current supplied from the AC power source PS according to the first embodiment of the present invention include: (A) the capacitor charger 203; (B) the DC power source generation circuit 204; (C) the AC heater drive circuit 205, and (D) others (e.g. dehumidification heater (not shown)). Here, (D) is ignored since the consumption amount is low compared to the others.

The capacitor charger 203 of (A) hardly consumes any power when the digital copying apparatus 1 is performing an image forming operation. That is, the AC current consumption amount of the capacitor charger 203 is small during the image forming operation. Meanwhile, since the capacitor charger 203 charges the capacitor CP1 in a short time during a waiting period, the power consumption of the capacitor charger 203 increases during the waiting period.

The DC power source generation circuit 204 of (B) consumes a large amount of AC current during the image forming operation of the digital copying apparatus 1. Meanwhile, the power consumption of the DC power source generation circuit 204 is decreased during the waiting period (the power consumption further decreases especially during a power save period).

The AC heater drive circuit 205 of (C) consumes a large amount of AC current during the image forming operation of the digital copying apparatus 1. Meanwhile, the power consumption of the AC heater drive circuit 205 is decreased during the waiting period since the AC heater drive circuit 205 is supplying power to the AC fixing heaters HT2 and HT3 during this period.

Since the heat of the fixing roller 301 is absorbed by the sheet 307 and the pressure roller 302 during the image forming operation of the digital copying apparatus 1, the period where the AC fixing heaters HT2 and HT3 are lit on increases, the light-on rate per unit of time becomes higher, and the AC current consumption becomes larger. Meanwhile, during the waiting period, the AC fixing heaters HT2 and HT3 are lit on only when the temperature of the fixing roller 301 is decreased caused by natural release of heat.

Under these conditions, figures of AC current consumption (rated values) is set in a manner shown below in a case of employing a relatively high speed/high performance digital copying apparatus 1 according to the first embodiment of the present invention.

(A) capacitor charger 203 . . . 0.2 A (during a non-charging period)/7.0 A (during a charging period)

(B) DC power source generation circuit 204 . . . 5.0 A (during an image forming period)/1.5 A (during a waiting period)

(C) AC heater drive circuit 205 . . . 9.5 A (during a lit on period)/0 A (during a lit-off period)

Furthermore, the rated value of the digital copying apparatus 1 is 15 A/1500 W.

Figure 7:
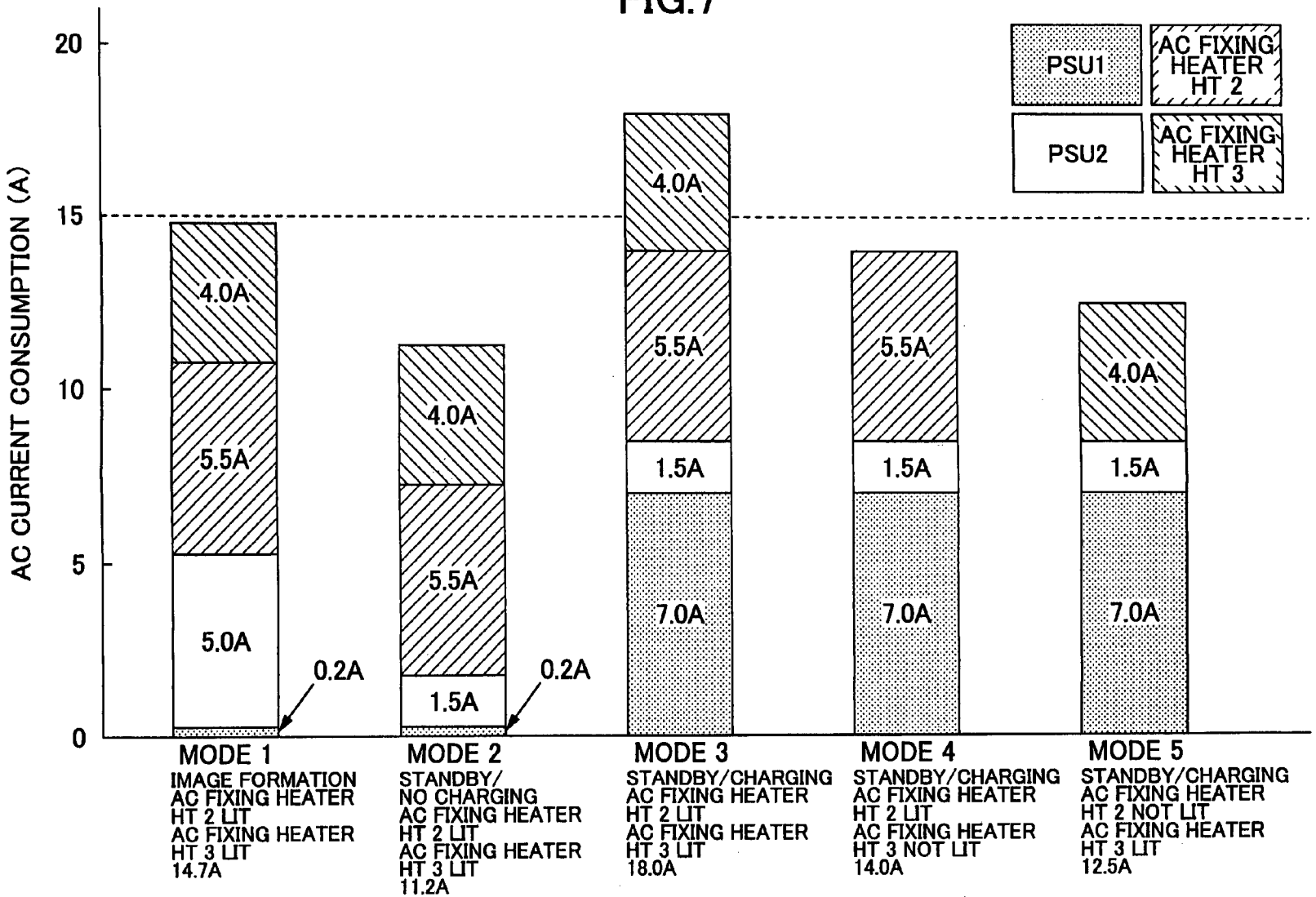
FIG. 7 is a schematic diagram showing examples of various modes of AC current consumption.
Figure 13:
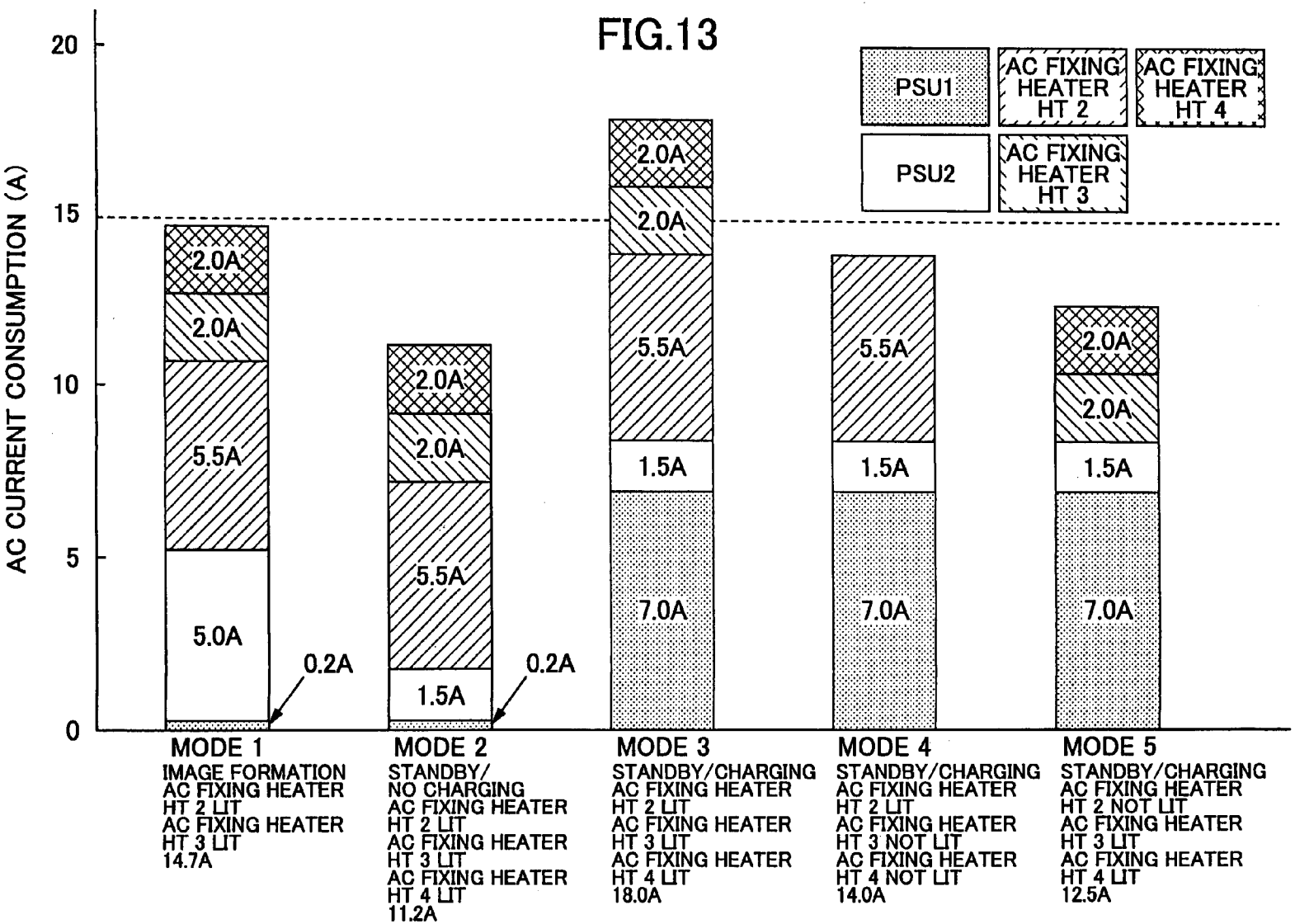
FIG. 13 is a schematic diagram showing examples of various modes of AC current consumption according to a second embodiment of the present invention.

In this case, exemplary modes including combinations of the above-described AC current consumption values are shown in FIG. 7 (In FIGS. 7 and 13, PSU1 indicates the capacitor charger 203, and PSU2 indicates the DC power source generation circuit 204).

Mode 1 is a mode where the AC fixing heaters HT2 and HT3 are both lit on during an image forming operation. Mode 2 is a mode where the AC fixing heaters HT2 and HT3 are both lit on during a waiting period and thus during a non-charging period of the capacitor CP1. Mode 3 is a mode where the AC fixing heaters HT2 and HT3 are both lit on during a waiting period and thus during a charging period of the capacitor CP1.

Mode 4 is a mode where the AC fixing heater HT2 is lit on and the AC fixing heater HT3 is lit-off during a waiting period and thus during a charging period of the capacitor CP1. Mode 5 is a mode where the AC fixing heater HT2 is lit-off and the AC fixing heater HT3 is lit on during a waiting period and thus during a charging period of the capacitor CP1.

Here, the sum of the AC current consumption amount in modes 1 and 2 is no more than the rated value of 15 A. Therefore, there is no particular disadvantage for modes 1 and 2. Meanwhile, since the capacitor CP1 is charged by the capacitor charger 203 in modes 3, the sum of the AC current consumption amount exceeds the rated value of 15 A (18.0 A).

In modes 4 and 5, either one of the AC fixing heaters HT2 and HT3 is lit on while the other is lit-off, that is, the AC fixing heaters HT2 and HT3 are not lit on at the same time. Therefore, the sum of the AC current consumption amount in modes 4 and 5 is no more than the rated value of 15 A even when charging the capacitor CP1 with the capacitor charger 203, in which the sum of the AC current consumption amount in modes 4 is 14.0 A, and the sum of the AC current consumption amount in modes 5 is 12.5 A.

Accordingly, in the first embodiment of the present invention, the AC fixing heaters HT2 and HT3 are not lit on at the same time during a waiting period of the digital copying apparatus 1 as shown in modes 4 and 5. In the first embodiment of the present invention, charging of the capacitor CP1 can be executed in a short period without exceeding the rated value of 15 A by charging the capacitor charger 203 in an amount corresponding to a current consumption amount of either one of the AC fixing heaters HT2 or HT3 that is lit-off.

That is, in the first embodiment of the present invention, the AC fixing heaters HT2 and HT3 are controlled so that the AC fixing heaters HT2 and HT3 are permitted to light-on in an alternating manner during a waiting period of the digital copying apparatus 1. Therefore, the AC fixing heaters HT2 and HT3 are not lit on at the same time during a waiting period of the digital copying apparatus 1.

Figure 8:
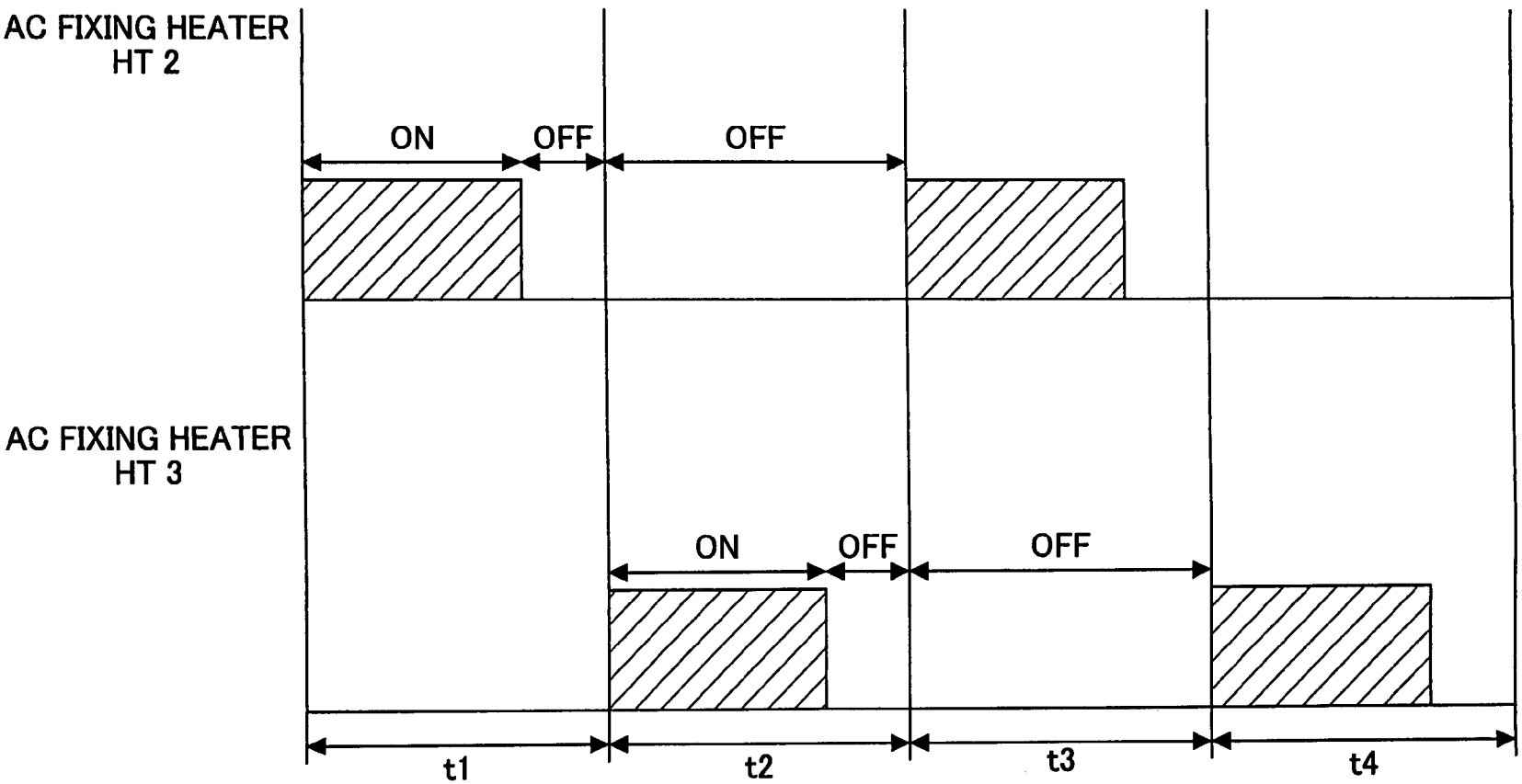
FIG. 8 is a drawing for showing an example of the timing in permitting alternate lighting-on of AC fixing heaters according to an embodiment of the present invention.

FIG. 8 is a drawing for showing the timing of permitting the alternate lighting-on of the AC fixing heaters HT2 and HT3. In FIG. 8, the AC fixing heater HT2 is permitted to light-on during periods t1 and t3. Meanwhile, the AC fixing heater HT3 is permitted to light-on during periods t2 and t4. It is to be noted that the AC fixing heaters HT2 and HT3 may be lit-off for a given time during the periods, and is not required to be lit on during the entire time of the period (for example, AC fixing heater HT2 during period t1). The lighting-on/off during the periods may be controlled by pulse width modulation.

Figure 9:
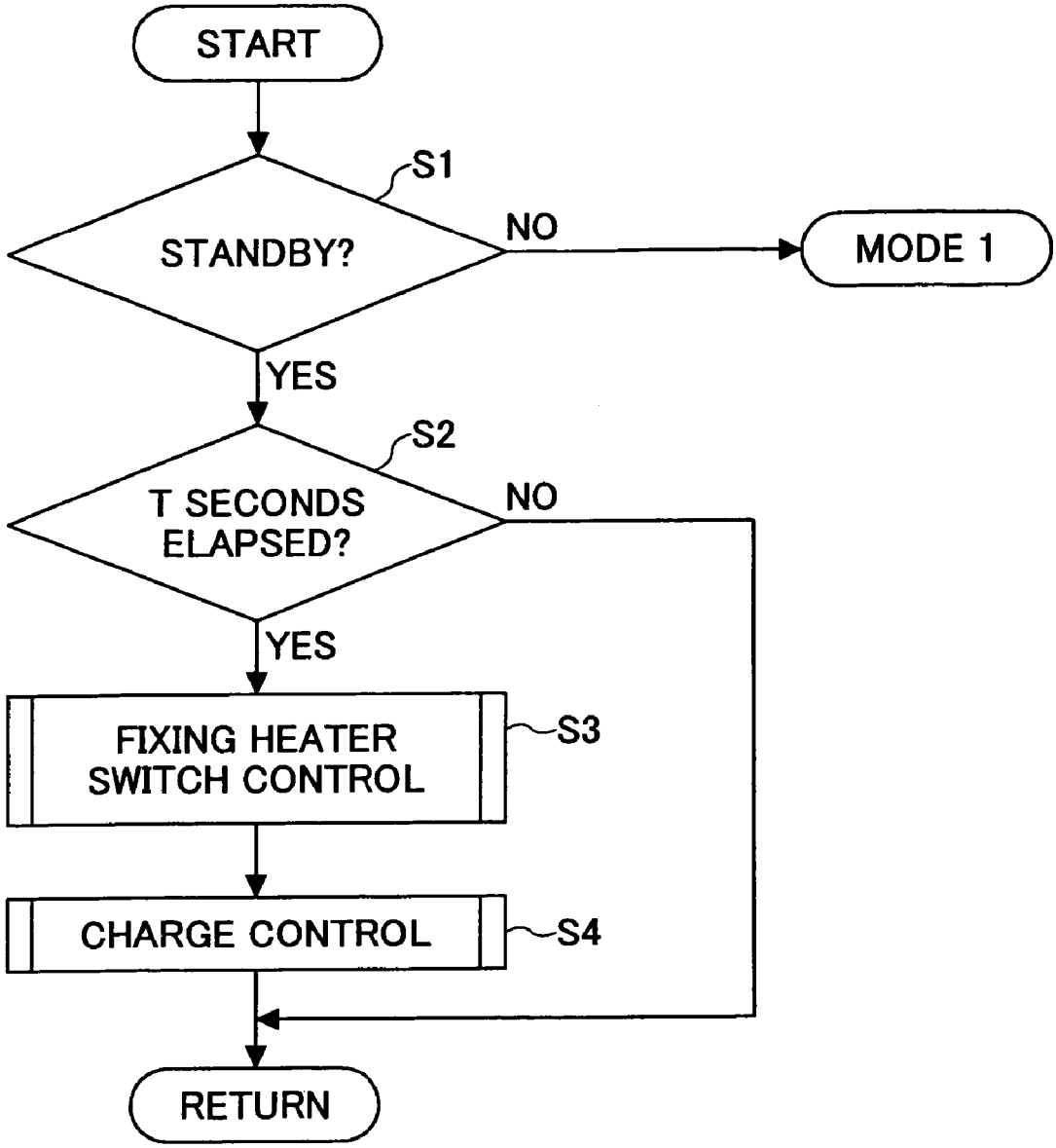
FIG. 9 is a flowchart showing an example of a basic fixing control operation.

FIG. 9 is a flowchart showing an exemplary operation of AC current consumption control executed by the CPU 241 in the control part 202. More specifically, FIG. 9 is a flowchart for describing basic execution of fixing control.

In Step S1, the CPU 241 determines whether the digital copying apparatus 1 is in a waiting state. When the digital copying apparatus 1 is not in a waiting state, but is instead in a image forming operation state (No in Step S1), the Mode 1 shown in FIG. 7 is executed. Meanwhile, when the digital copying apparatus 1 is in a waiting state (Yes in Step S2), the operation proceeds to Step S2, in which the CPU 241 determines whether a predetermined time T seconds (for example, period t1 shown in FIG. 8) has elapsed.

If the predetermined time T seconds has not elapsed (No in Step S2), the operation returns to Step S1. If the predetermined time T seconds has elapsed (Yes in Step S2), the operation proceeds to Step S3, in which an operation of a fixing heater switch control shown in FIG. 10 is executed.

Figure 10:
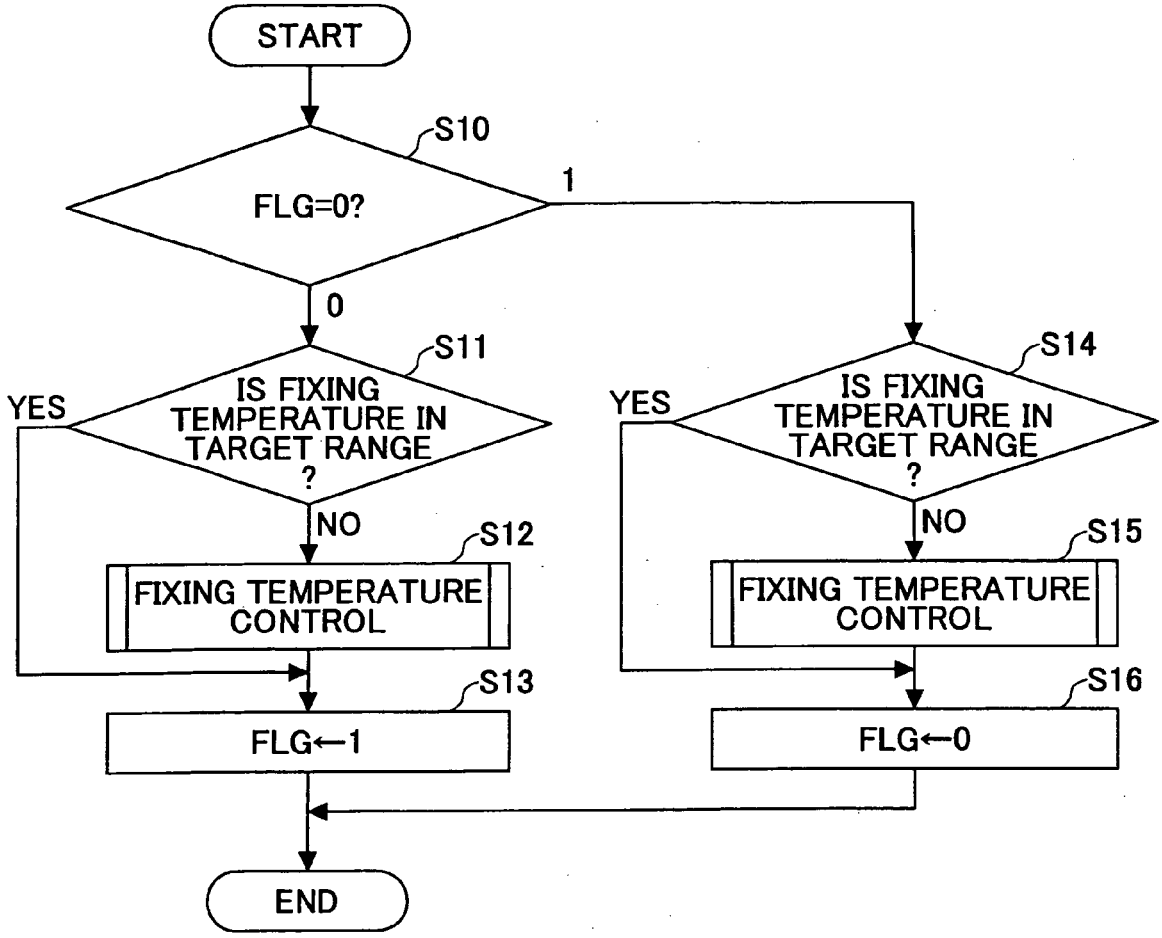
FIG. 10 is a flowchart showing an example of a fixing heater switch control operation.

FIG. 10 is a flowchart showing an exemplary operation of fixing heater switch control. The digital copying apparatus 1 is set with flags which indicate which one of the AC fixing heaters HT2, HT3 is permitted to light-on. For example, a flag "0" indicates that the AC fixing heater HT2 is permitted to light-on, and a flag "1" indicates that the AC fixing heater HT3 is permitted to light-on.

In Step S10, the CPU 241 determines whether the flag, indicating permission of lighting-on of the AC fixing heaters HT2 and HT3, is "0" or "1". When the flag is "0" (0 of Step S10), the CPU 241 determines that lighting-on of the AC fixing heater HT2 is permitted, thereby proceeding to Step S11.

In Step S11, the CPU 241 determines whether the fixing temperature of the fixing roller 301, which is detected by the temperature sensor TH11, is in a predetermined predetermined target range. It is to be noted that the temperature sensor TH11 is disposed in correspondence with, for example, the area of the fixing heater HT2. When the fixing temperature is in the predetermined predetermined target range (Yes in Step S11), the operation proceeds to Step S13 since no heating of the fixing roller 301 is necessary. In Step S13, the flag is set to "1", thus completing the fixing heater switch control operation. Meanwhile, when the fixing temperature is not in the predetermined target range (No in Step S11), the operation proceeds to Step S12 since heating of the fixing roller 301 is necessary. In Step S12, a fixing temperature control operation, as shown in FIG. 11, is executed.

Figure 11:
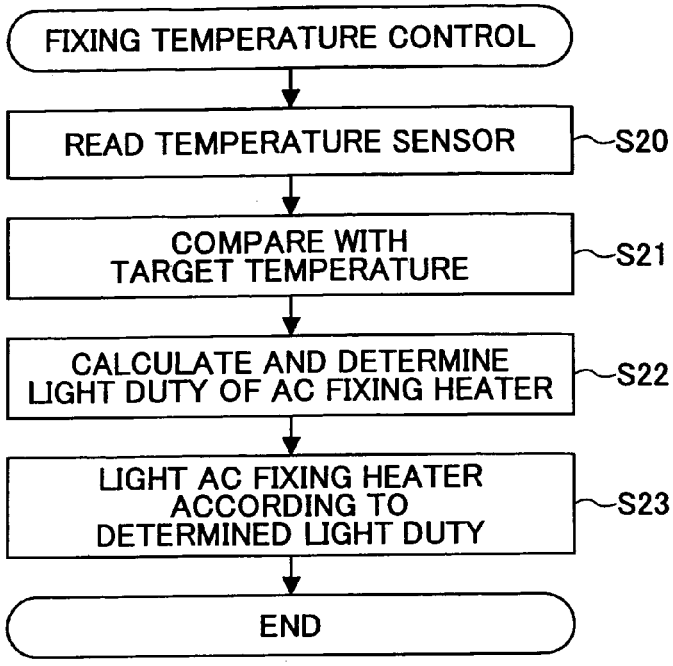
FIG. 11 is a flowchart showing an example of a fixing temperature control operation.

FIG. 11 is a flowchart showing an exemplary operation of fixing temperature control. In Step S20, the CPU 241 reads the fixing temperature of the fixing roller 301 detected by the temperature sensor TH11. Then, in Step S21, the CPU 241 compares the read fixing temperature of the fixing roller 301 with a target temperature. Then, in Step S22, the CPU 241 calculates and determines a light-on duty of the AC fixing heater HT2 according to the results of the comparison between the read fixing temperature of the fixing roller 301 and the target temperature. In the calculation and control of the light-on duty, P control, PI control, and/or PID control, for example, can be employed.

In Step S23, the control signal S8 corresponding to the AC heater drive circuit 205 is switched on in accordance with the determined light-on duty, thereby lighting-on the AC fixing heater HT2. That is, the Mode 4 shown in FIG. 7 is executed. As shown in FIG. 8, the AC fixing heater HT2 does not need to be constantly lit on during the permitted period, but may be lit-off in accordance with the determined light-on duty (for example, period t1 in FIG. 8). After the fixing temperature control operation of Step S12 in FIG. 10 is completed, the operation proceeds to Step S13. In Step S13, the flag is set to "1", thus completing the fixing heater switch control operation. That is, in Step S13, the flag "0" for indicating permission of lighting on the AC fixing heater HT2 is switched to the flag "1" for indicating permission of lighting on the AC fixing heater HT3.

Meanwhile, in Step S10, the CPU 241 determines that the AC fixing heater HT3 is permitted to light-on when the flag is not "0" (1 in Step S10), thereby proceeding to Step S14.

In Step S14, the CPU 241 determines whether the fixing temperature of the fixing roller 301, which is detected by the temperature sensor TH12, is in a predetermined target range. It is to be noted that the temperature sensor TH12 is disposed in correspondence with, for example, the area of the fixing heater HT3. When the fixing temperature is in the predetermined target range (Yes in Step S14), the operation proceeds to Step S16 since no heating of the fixing roller 301 is necessary. In Step S16, the flag is set to "0", thus completing the fixing heater switch control operation. Meanwhile, when the fixing temperature is not in the predetermined target range (No in Step S14), the operation proceeds to Step S15 since heating of the fixing roller 301 is necessary. In Step S15, the fixing temperature control operation, as shown in FIG. 11, is executed.

In Step S20, the CPU 241 reads the fixing temperature of the fixing roller 301 detected by the temperature sensor TH12. Then, in Step S21, the CPU 241 compares the read fixing temperature of the fixing roller 301 with a target temperature. Then, in Step S22, the CPU 241 calculates and determines a light-on duty of the AC fixing heater HT3 according to the results of the comparison between the read fixing temperature of the fixing roller 301 and the target temperature. In the calculation and control of the light-on duty, P control, PI control, and/or PID control, for example, can be employed.

In Step S23, the control signal S10 corresponding to the AC heater drive circuit 205 is switched on in accordance with the determined light-on duty, thereby lighting-on the AC fixing heater HT3. That is, the Mode 5 shown in FIG. 7 is executed. As shown in FIG. 8, the AC fixing heater HT3 does not need to be constantly lit on during the permitted period, but may be lit-off in accordance with the determined light-on duty (for example, period t2 in FIG. 8). After the fixing temperature control operation of Step S15 in FIG. 10 is completed, the operation proceeds to Step S16. In Step S16, the flag is set to "0", thus completing the fixing heater switch control operation. That is, in Step S16, the flag "1" for indicating permission of lighting on the AC fixing heater HT3 is switched to the flag "0" for indicating permission of lighting on the AC fixing heater HT2.

In the fixing heater switch control operation shown in FIG. 10, the AC fixing heaters HT2 and HT3 are alternately permitted to light-on with use of the above-described flags. Accordingly the AC fixing heaters HT2 and HT3 are not lit on at the same time during a waiting period of the digital copying apparatus 1.

Figure 12:
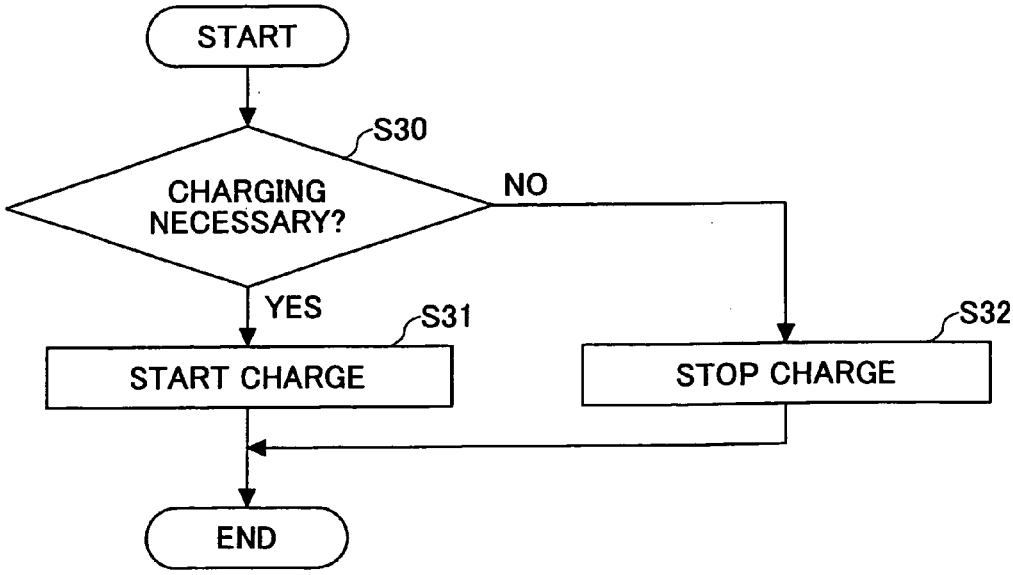
FIG. 12 is a flowchart showing an example of a charge control operation.

With reference to the operation shown in FIG. 9, after the fixing heater switch control operation is finished, the operation proceeds to Step S4, in which a charge control operation shown in FIG. 12 is executed. FIG. 12 is a flowchart showing a charge control operation. In Step S30, the CPU 241 determines whether charging of the capacitor CP1 is necessary. It is to be noted that, the necessity of charging the capacitor CP1 may be determined by determining whether the charge voltage of the capacitor CP1, which is detected by the both end voltage detection circuit 232, is lower than a predetermined value.

If charging of the capacitor CP1 is determined to be unnecessary (No in Step S30), the operation proceeds to Step S32. After charging of the capacitor CP1 is stopped in Step S32, the charge control operation shown in FIG. 12 is completed. That is, the Mode 2 in FIG. 7 is executed.

Meanwhile, if charging of the capacitor CP1 is determined to be necessary (Yes in Step S30), the operation proceeds to Step S31. After charging of the capacitor CP1 is started in Step S31, the charge control operation shown in FIG. 12 is completed. After the charge control of FIG. 12 is completed, the operation returns to Step S1 shown in FIG. 9.

Accordingly, the first embodiment of the present invention controls the operation of the AC heater drive circuit 205 so that the AC fixing heaters HT2 and HT3 are not lit-up at the same time during a waiting period of the digital copying apparatus 1. This ensures the capacitor charger 203 a current consumption amount amounting to the AC current consumption amount of either one of the lit-off AC fixing heaters HT2 or HT3. That is, in a case of charging the capacitor CP1 with the capacitor charger 203, modes 4 or 5 can be executed instead of executing mode 3.

It is to be noted that, even where the AC fixing heaters HT2 and HT3 are controlled to alternately light-on, the digital copying apparatus 1 is designed so that the fixing temperature during a waiting period satisfies a predetermined design standard. Furthermore, by lighting-on the AC fixing heaters HT2 and HT3 alternately at intervals of T seconds, the AC fixing heaters HT2 and HT3 would not be lit on at the same time. Therefore, the mode 3 shown in FIG. 3 would not be executed.

With reference to FIG. 7, in a transition from an image forming period to a waiting period, the AC current consumption amount required for the DC power source generation circuit 204 decreases from 5.0 A to 1.5 A. Therefore, an AC current consumption amount amounting to 3.5 A is required to be charged by the capacitor charger 203 during the waiting period.

Here, since the sum of AC current consumption amount required for a charging operation by the capacitor charger 203 is set as 7.0 A according to the first embodiment of the present invention, merely an AC current consumption amount amounting to the AC current consumption amount of the DC power source generation circuit 204 would be insufficient for the capacitor charger 203. Therefore, an AC current consumption amount for either one of the lit-off AC fixing heaters HT2 or HT3 is to be supplemented for the insufficient amount of approximately 3.5 A. In this case, the amount of the supplementing current (in this case, approximately 3.5 A) is set as a value that is no more than a value of a least rated consumption current of the AC fixing heater HT3 (in this case, no more than 4.0 A), wherein the AC fixing heater HT3 has a rated consumption current that is smaller than that of the AC fixing heater HT2.

By setting the amount of the supplementing current in such manner, the sum of the AC current consumption can be reliably restrained to a value below the rated value of 15 A even when the AC fixing heater HT2 having a larger consumption current is lit on at the same time of charging with the capacitor charger 203. In other words, taking the supplementing amount of approximately 3.5 A, the AC current consumption amount of the capacitor charger 203 is set to 7.0 A.

In the charging of the capacitor CP1 during the waiting period according to the first embodiment of the present invention, the AC fixing heaters HT2 and HT3 are prevented from lighting-on at the same time by executing the control, shown in steps S12 and S15 of FIG. 10, for alternately lighting-on (i.e. alternately lighting-off) the AC fixing heaters HT2 and HT3. Accordingly, although the lighting-on of the AC fixing heaters HT2 and HT3 are controlled in the above-described manner, the AC fixing heaters HT2 and HT3, as a whole, are able to provide balanced satisfactory heating.

All the AC fixing heaters HT2 and HT3 are controlled so that the AC fixing heaters HT2 and HT3 would not light-on at the same time throughout the waiting period according to the first embodiment of the present invention, the AC fixing heaters HT2 and HT3 may be controlled not to light-on only when charging is executed during the waiting period. For example, temperature ripple of the fixing roller 301 in a non-charging state during a waiting period can be reduced by lighting-on the AC fixing heaters HT2 and HT3 at the same time in a waiting period except during the charging operation.

Second Embodiment

Next, a second embodiment of the present invention is described with reference to FIG. 13. In the below-given description of the second embodiment of the present invention, like components are denoted with like numerals as of the first embodiment of the present invention.

Although the second embodiment of the present invention has a configuration that is basically the same as that of the first embodiment of the present invention, the second heating member of the second embodiment of the present invention, being driven by the AC heater drive circuit 205, includes three AC fixing heaters HT2, HT3, and HT4. More specifically, the AC fixing heater HT3 in the first embodiment of the present invention is divided into AC fixing heaters HT3 and HT4. In the second embodiment of the present invention, the rated AC current consumption amount of each of the AC fixing heaters HT2, HT3, and HT4 is 2.0 A.

Although the positions of the AC fixing heaters HT2, HT3, and HT4 are not shown in the drawings, the AC fixing heater HT2 may be disposed, in correspondence with a small size area, at a center area with respect to a main scanning direction, and the AC fixing heaters HT3 and HT4 may be disposed, in correspondence with a large size area, at both sides with respect to a main scanning direction.

In this case, exemplary modes including combinations of the above-described AC current consumption values are shown in FIG. 13. Mode 1 is a mode where the AC fixing heaters HT2, HT3, and HT4 are all lit on during an image forming operation. Mode 2 is a mode where the AC fixing heaters HT2, HT3, and HT4 are all lit on during a waiting period and thus during a non-charging period of the capacitor CP1. Mode 3 is a mode where the AC fixing heaters HT2, HT3, and HT4 are all lit on during a waiting period and thus during a charging period of the capacitor CP1.

Mode 4 is a mode where the AC fixing heater HT2 is lit on and the AC fixing heaters HT3 and HT4 are lit-off during a waiting period and thus during a charging period of the capacitor CP1. Mode 5 is a mode where the AC fixing heater HT2 is lit-off and the AC fixing heaters HT3 and HT4 are lit on during a waiting period and thus during a charging period of the capacitor CP1.

Here, the sum of the AC current consumption amount in modes 1 and 2 is no more than the rated value of 15 A. Therefore, there is no particular disadvantage for modes 1 and 2. Meanwhile, since the capacitor CP1 is charged by the capacitor charger 203 in Mode 3, the sum of the AC current consumption amount exceeds the rated value of 15 A (18.0 A).

In Mode 4, the AC fixing heater H2 having the largest rated current consumption amount among the three AC fixing heaters HT2, HT3, and HT4 is lit on while the remaining AC fixing heaters HT3 and HT4 are lit-off, thereby preventing the AC fixing heaters HT2, HT3, and HT4 from being lit on at the same time. Accordingly, the mode 4 enables the sum of the AC current consumption amount to be controlled to a value of no more than 15 A (in this case, 14.0 A) even when the capacitor charger 203 executes a charging operation. Therefore, there is no particular disadvantage in Mode 4.

Meanwhile, in Mode 5, the AC fixing heater H2 having the largest rated current consumption amount among the three AC fixing heaters HT2, HT3, and HT4 is lit-off while the remaining AC fixing heaters HT3 and HT4 are lit on when executing the charging operation during a waiting period. Accordingly, the three AC fixing heaters HT2, HT3, and HT4 are not lit on at the same time. Therefore, even when the capacitor charger 203 executes the charging operation during the waiting period, the sum of the AC current consumption amount is a value no more than the rated value of 15 A (in this case, 12.5 A). Therefore, there is no particular disadvantage in Mode 5.

Accordingly, in the second embodiment of the present invention, the AC fixing heaters HT2, HT3, and HT4 are not lit on at the same time during a waiting period of the digital copying apparatus 1 as shown in modes 4 or 5 shown in FIG. 13. In the second embodiment of the present invention, charging of the capacitor CP1 can be executed in a short period without exceeding the rated value of 15 A by charging the capacitor charger 203 in an amount corresponding to a current consumption amount of the AC fixing heaters HT3 and HT4 that are lit-off or the AC fixing heater HT2.

More specifically, the combination of AC fixing heaters is controlled so that the sum of the rated current amount of the AC fixing heater(s) which is lit on during a waiting period is less than that of the AC fixing heater having the largest rated current amount among the AC fixing heaters (in this case, 5.5 A), thereby ensuring a sufficient current consumption amount to supplemented during a charging operation.

An example of executing the operation of the second embodiment of the present invention is described with reference to FIG. 10. In Step S12, the CPU 241 controls the control signal for the AC drive circuit 205 so that only the AC fixing heater HT2 is lit on while the AC fixing heaters HT3 and HT4 are lit-off, while also charging the capacitor CP1 with the capacitor charger 203 (i.e. executing mode 4 in FIG. 13). In Step S15, the CPU 241 controls the control signal for the AC drive circuit 205 so that the AC fixing heaters HT3 and HT4 are lit on while the AC fixing heater HT2 is lit-off, while also charging the capacitor CP1 with the capacitor charger 203 (i.e. executing modes 5 in FIG. 13). Although the AC fixing heaters HT3 and HT4, being disposed at both sides with respect to the main scanning direction, are controlled not to be lit on/off at the same time with the AC fixing heater HT2, the AC fixing heaters HT2, HT3, and HT4, as a whole, are able to provide balanced satisfactory heating.

Accordingly, the second embodiment of the present invention controls the operation of the AC heater drive circuit 205 so that the AC fixing heaters HT2, HT3, and HT4 are not lit-up at the same time during a waiting period of the digital copying apparatus 1 (Step S12 and S15). This ensures the capacitor charger 203 a current consumption amount amounting to the AC current consumption amount of the lit-off AC fixing heaters HT2 and HT3, or that of the AC fixing heater HT2. That is, in a case of charging the capacitor CP1 with the capacitor charger 203, modes 4 or 5 can be executed instead of executing modes 3 shown in FIG. 13.

With reference to FIG. 13, in a transition from an image forming period to a waiting period, the AC current consumption amount required for the DC power source generation circuit 204 decreases from 5.0 A to 1.5 A. Therefore, an AC current consumption amount amounting to 3.5 A is required to be charged by the capacitor charger 203 during the waiting period.

Here, since the sum of AC current consumption amount required for a charging operation by the capacitor charger 203 is set as 7.0 A according to the second embodiment of the present invention, merely an AC current consumption amount amounting to the AC current consumption amount of the DC power source generation circuit 204 would be insufficient for the capacitor charger 203. Therefore, an AC current consumption amount for the lit-off AC fixing heaters HT2, HT3 and/or HT4 is to be supplemented for the insufficient amount of approximately 3.5 A. In this case, the amount of the supplementing current (in this case, approximately 3.5 A) is set as a value that is no more than a value of a rated consumption current of the sum of the AC fixing heaters HT3 and HT4 (i.e. excluding that of the AC fixing heater HT2 having the largest rated consumption current (5.5 A)) where in this case, a value of no more than 4.0 A.

By setting the amount of the supplementing current in such manner, the sum of the AC current consumption can be reliably restrained to a value below the rated value of 15 A even when the AC fixing heater HT2 having a larger consumption current is lit on at the same time of charging with the capacitor charger 203. In other words, taking the supplementing amount of approximately 3.5 A, the AC current consumption amount of the capacitor charger 203 is set to 7.0 A.

Third Embodiment

Next, a third embodiment of the present invention is described with reference to FIG. 14. In the below-given description of the third embodiment of the present invention, like components are denoted with like numerals as of the first embodiment of the present invention. In a charging operation during a waiting period of the digital copying apparatus 1 for supplementing at least a portion of the current consumption amount of the AC heater circuit 205 to the current consumption amount of the capacitor charger 203 according to the third embodiment of the present invention, the CPU 24 executes a control enabling the capacitor charger 203 to charge the capacitor CP1 in a timing where at least one of two AC fixing heaters HT2 and HT3 (as in the first embodiment of the present invention) is not required to be lit on.

For example, the AC fixing heater HT2 and the HT3, such as in the above-described first embodiment of the present invention, are controlled to alternately light-on by the transmission of control signals S8 and S10 to the AC heater drive circuit when the fixing temperature of the fixing roller 301 is lower than the predetermined target range. In addition, the AC fixing heater HT2 and the HT3 are controlled not to light-on when the fixing temperature is in the predetermined target range. This case where the fixing temperature is in the predetermined target range can be further categorized into a case (period) where the AC fixing heaters HT2 and HT3 are both not required to be lit on, a case (period) where only the AC fixing heater HT2 is required to be lit on, and a case (period) where only the AC fixing heater HT3 is required to be lit on.

During these cases (periods), the AC current consumption amount of the lit-off AC fixing heaters HT2 or HT3 can be supplemented to the AC current consumption amount of the capacitor charger 203. By executing the charging operation at a timing (period) where at least one of the AC fixing heaters HT2 and HT3 is not required to be lit on, the capacitor CP1 can be efficiently charged during a waiting period without exceeding the rated current value of 15 A.

Next, an AC current consumption control operation executed by the CPU 241 in the control part 202 according to the third embodiment of the present invention is described. The third embodiment of the present invention is described with reference to the flowchart shown in FIG. 14 owing that the fixing heater switch control of step S9 shown in FIG. 9 is different from that of the first embodiment of the present invention.

Figure 14:
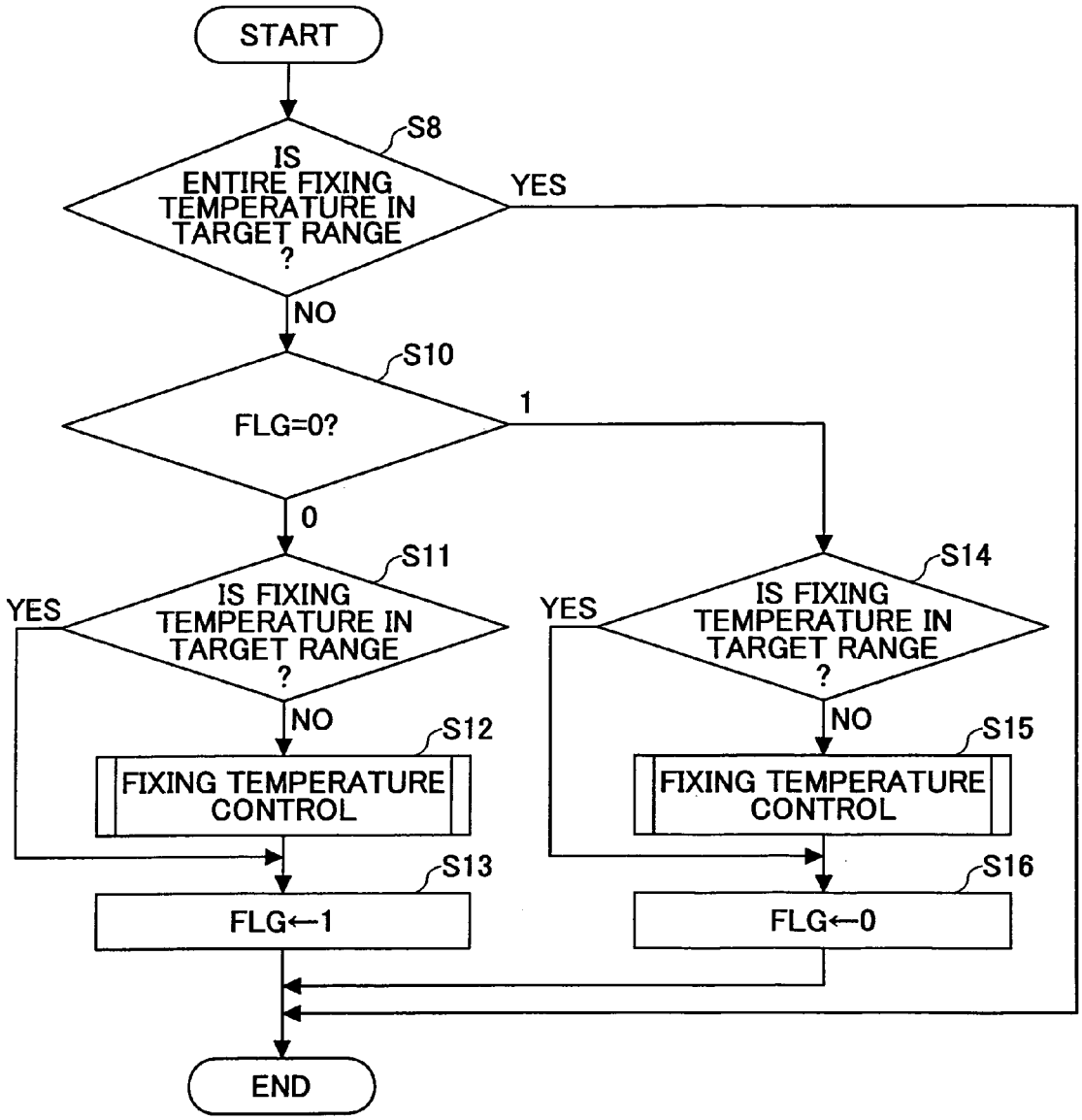
FIG. 14 is a flowchart showing an example of a fixing temperature control operation according to a third embodiment of the present invention.
Figure 15:
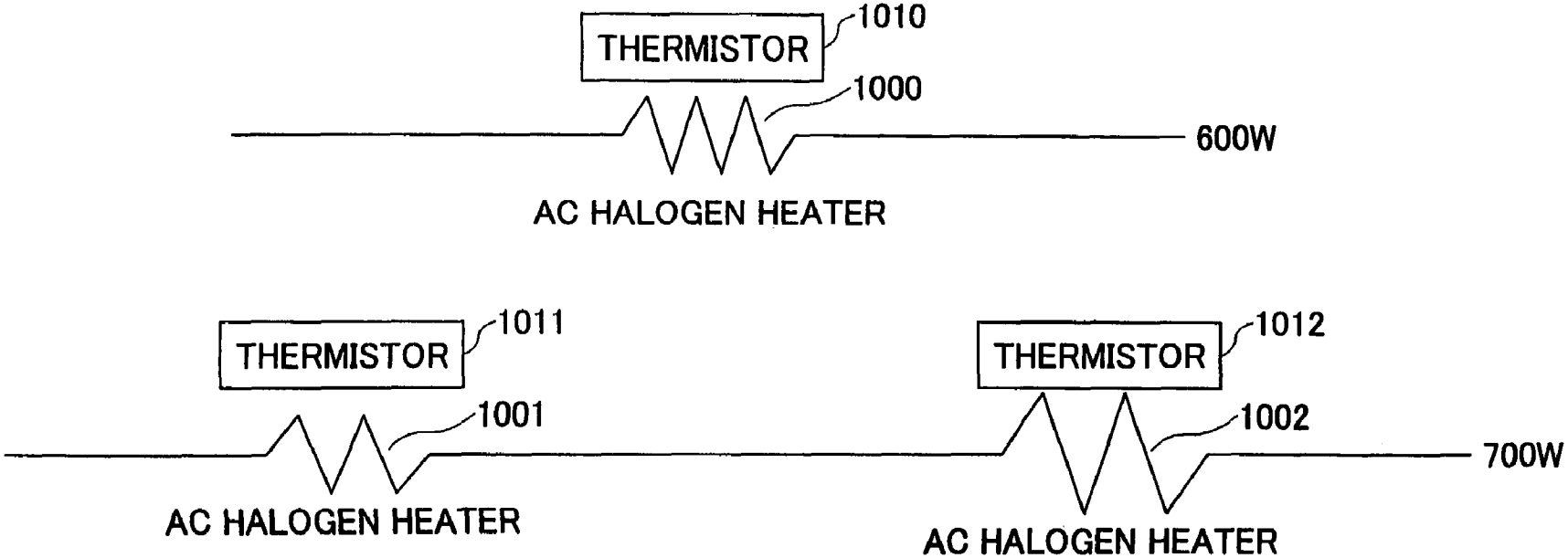
FIG.15 PRIOR ART
FIG. 15 is a drawing showing an exemplary configuration of AC halogen heaters in a fixing roller.

FIG. 14 is a flowchart showing an exemplary operation of a fixing heating switch control according to the third embodiment of the present invention. In step S8, the CPU 241 determines whether the entire fixing temperature of the fixing roller 301, being monitored by the temperature sensors TH11 and TH12, is in a predetermined target range.

If the entire fixing temperature is determined to be in the predetermined target range (Yes in Step S8), the fixing heater switch control operation is completed since heating to the fixing roller 301 is unnecessary.

Meanwhile, if the entire fixing temperature is determined not to be in the predetermined target range (No in Step S8), the operation proceeds to Step S10. In Step S10, the CPU 241 determines whether a flag is "0" or "1". When the flag is "0" (0 in Step S10), the CPU 241 determines that lighting-on of the AC fixing heater HT2 is permitted, thereby proceeding to Step S11.

In Step S11, the CPU 241 determines whether the fixing temperature of the fixing roller 301, being detected by the temperature sensor TH11, is in a predetermined target range. It is to be noted that the temperature sensor TH11 is disposed in correspondence with, for example, the area of the AC fixing heater HT2. When the fixing temperature is in the predetermined target range (Yes in Step S11), the operation proceeds to Step S13 since heating of the fixing roller 301 is unnecessary. Then, after the flag is set to "1", the operation is completed. Meanwhile, when the fixing temperature is not in the predetermined target range (No in Step S11), the operation proceeds to Step S12 since heating of the fixing roller 301 is necessary. Then, in Step S12, the fixing temperature control operation shown in FIG. 11 is executed, in which the AC fixing heater HT2 is lit-up by the AC heater drive circuit 205. After the fixing temperature control operation in Step S12 is completed, the operation proceeds to Step S13. After the flag is set to "1" in Step S13, the operation is completed. That is, the modes 4 of FIG. 7 is performed on the AC current consumption amount.

Meanwhile, when the flag is not "0" in Step S10 (1 in Step S10), the CPU 241 determines that the lighting-on of the AC fixing heater HT3 is permitted, to thereby proceed to Step S14. In Step S14, the CPU 241 determines whether the fixing temperature of the fixing roller 301, being detected by the temperature sensor TH12, is in a predetermined target range. It is to be noted that the temperature sensor TH12 is disposed in correspondence with, for example, the area of the AC fixing heater HT3. When the fixing temperature is in the predetermined target range (Yes in Step S14), the operation proceeds to Step S16 since heating of the fixing roller 301 is unnecessary. Then, after the flag is set to "0", the operation is completed. Meanwhile, when the fixing temperature is not in the predetermined target range (No in Step S14), the operation proceeds to Step S15 since heating of the fixing roller 301 is necessary. Then, in Step S15, the fixing temperature control operation shown in FIG. 11 is executed, in which the AC fixing heater HT3 is lit-up by the AC heater drive circuit 205. After the fixing temperature control operation in Step S15 is completed, the operation proceeds to Step S16. After the flag is set to "0" in Step S16, the operation is completed. That is, the mode 5 of FIG. 7 is performed on the AC current consumption amount.

In the fixing heater switch control operation shown in FIG. 14, the flag is set to alternately permit lighting-on of the AC fixing heaters HT2 and HT3. Accordingly, the AC fixing heaters HT2 and HT3 are prevented from being lit on at the same time during the charging of the capacitor CP1 during the waiting period.

In the third embodiment of the present invention, the CPU 241 monitors the entire output from the temperature sensors TH11 and TH12. Then, when the fixing temperature of the fixing roller 301 is lower than a predetermined predetermined target range (No in Step S8 in FIG. 14), the CPU 241 monitors the respective output of the temperature sensors TH11 and TH12. That is, the CPU 241 determines whether the fixing temperature corresponding to a portion of the AC fixing heater HT2 in the fixing roller 301 is equal to or greater than a predetermined predetermined target range, and whether the fixing temperature corresponding to a portion of the AC fixing heater HT3 in the fixing roller 301 is equal to or greater than a predetermined predetermined target range, respectively (Step S11 and S14 in FIG. 14).

When the fixing temperature of the portion corresponding to the AC fixing heater HT2 is no more than the predetermined predetermined target range (No in Step S11 in FIG. 14), the CPU 241 controls the control signal S8 to the AC heater drive circuit 205 for lighting-on the AC fixing heater HT2 (Step S12 in FIG. 14). When the fixing temperature of the portion corresponding to the AC fixing heater HT3 is no more than the predetermined predetermined target range (No in Step S14 in FIG. 14), the CPU 241 241 controls the control signal S10 to the AC heater drive circuit 205 for lighting-on the AC fixing heater HT3 (Step S15 in FIG. 14).

Accordingly, a state where at least one of the AC fixing heaters HT2 and HT3 requires no lighting-on is obtained. At such timing(s), the CPU 241 monitors the charge voltage of the capacitor CP1 detected by the both end voltage detection circuit 232, determines whether charging is necessary, and enables the capacitor charger 203 to charge the capacitor CP1 when charging is determined necessary. By enabling the capacitor charger 203 to execute the charging operation at a timing(s) where lighting-on of at least one of the AC fixing heaters HT2, HT3 is unnecessary, the consumption current amount for the AC fixing heater HT2 or HT3, which is unnecessary for the AC heater drive circuit, can be supplemented for charging.

Accordingly, with the third embodiment of the present invention, the operation of the AC heater drive circuit 205 during the waiting period of the digital copying apparatus 1 can be controlled so that the AC fixing heaters HT2 and HT3 are not lit on at the same time, thereby enabling a desired amount of consumption current to be supplemented to the capacitor charger 203. Furthermore, the third embodiment of the present invention reduces temperature ripple of the fixing roller 301 in a non-charging state during a waiting period.

Although the third embodiment of the present invention is applied to the first embodiment of the present invention which employs two AC fixing heaters as the second heating member, the third embodiment of the present invention may also be applied to a case described in the second embodiment of the present invention which employs three or more AC fixing heating members as the second heating member. Furthermore, although AC consumption current (AC consumption current amount) is used to express amount of AC consumption electricity (AC consumption electricity amount) in the aforementioned embodiments of the present invention, AC consumption power may alternatively be used.

Further, the present invention is not limited to these embodiments, but various variations and modifications may be made without departing from the scope of the present invention.

The present application is based on Japanese priority application Nos. 2004-025512 and 2004-366133 filed on Feb. 2, 2004, and Dec. 17, 2004, respectively, with the Japanese Patent Office, the entire contents of which are hereby incorporated by reference.

What is claimed is:

1. An image forming apparatus for forming an image with a fixing member, which fixing member includes a first heating member and a plurality of second heating members, the image forming apparatus comprising:

a capacitor;

a charging part for charging the capacitor;

a first drive part for lighting on/off the first heating member by controlling a first power supply to the first heating member;

a second drive part for lighting on/off at least one of the plurality of second heating members by controlling a second power supply to the plurality of second heating members; and a control part for dividing the plurality of second heating members into groups and permitting at least one of the groups to receive the second power supply during a waiting period of the image forming apparatus.

2. The image forming apparatus as claimed in claim 1, wherein the group permitted to receive the second power supply is switched at predetermined intervals of time by the control part.

3. The image forming apparatus as claimed in claim 1, wherein the control part controls the second power supply of the second drive part so that the plurality of second heating members are not lit on at the same time during the waiting period of the image forming apparatus.

4. The image forming apparatus as claimed in claim 1, wherein the control part controls the second power supply of the second drive part so that at least a portion of a consumption electricity amount of the second heating member is supplemented to a consumption electricity amount of the charging part.

5. The image forming apparatus as claimed in claim 4, wherein the control part divides the plurality of the second heating members in a manner that the second heating member having the largest consumption electricity amount among the plurality of second heating members does not have a consumption electricity amount that is greater than a total consumption electricity amount of the plurality of second heating member when the plurality of second heating members are lit on at the same time.

6. The image forming apparatus as claimed in claim 5, wherein the consumption electricity amount supplemented to the consumption electricity amount of the charging part is no more than a total consumption electricity amount of the plurality of second heating members excluding the second heating member having the largest consumption electricity amount.

7. The image forming apparatus as claimed in claim 6, wherein the consumption electricity amount supplemented to the consumption electricity amount of the charging part is no more than the second heating member having the least consumption electricity amount among the plurality of second heating members in a case where the plurality of second heating members consist of two second heating members.

8. The image forming apparatus as claimed in claim 1, wherein control part controls the charging of charging part so that the capacitor is charged at a timing when at least one of the plurality of second heating members is not required to be lit on.

9. The image forming apparatus as claimed in claim 4, wherein the consumption electricity amount is expressed as an amount of consumption current or an amount of consumption current.

10. The image forming apparatus as claimed in claim 1, further comprising:

a temperature sensor being disposed at a surface of the fixing member for detecting surface temperature of the fixing member, wherein the control part determines a timing for lighting on/off the plurality of second heating members by comparing the surface temperature detected by the temperature sensor with respect to a predetermined target range.

11. The image forming apparatus as claimed in claim 10, wherein the control part determines to light-on the second heating member when the detected surface temperature is lower than the predetermined target range.

12. The image forming apparatus as claimed in claim 10, wherein when the detected surface temperature is lower than the predetermined target range, the control part determines a period for lighting on/off the second heating members in accordance with a difference of temperature between the detected surface temperature and the predetermined target range.

13. The image forming apparatus as claimed in claim 10, wherein the temperature sensor is disposed at a position corresponding to an area of the plurality of second heating members.

14. A power supply control method for controlling an image forming apparatus for forming an image with a fixing member, which fixing member includes a first heating member for receiving power supply from a capacitor and a plurality of second heating members, the power supply control method comprising the steps of:

a) dividing the plurality of second heating members into groups;

b) permitting at least one of the groups to receive a power supply during a waiting period of the image forming apparatus;

c) controlling the power supply to the plurality of second heating members for lighting on the group permitted to receive the power supply; and d) charging the capacitor.

15. The power supply control method as claimed in claim 14, wherein the group permitted to receive the second power supply in step a) is switched at predetermined intervals of time.

16. The power supply control method as claimed in claim 14, wherein the power supply for the plurality of second heating members is controlled so that the plurality of second heating members are not lit on at the same time during the waiting period of the image forming apparatus.

17. A power supply control program for controlling an image forming apparatus for forming an image with a fixing member, which fixing member includes a first heating member for receiving power supply from a capacitor and a plurality of second heating members, the program comprising:

a dividing function for dividing the plurality of second heating members into groups;

a permitting function for permitting at least one of the groups to receive a power supply during a waiting period of the image forming apparatus;

a controlling function for controlling the power supply to the plurality of second heating members for lighting on the group permitted to receive the power supply; and a charging function for charging the capacitor.

* * * * *